US008422937B2

(12) United States Patent
Kushida et al.

(10) Patent No.: US 8,422,937 B2
(45) Date of Patent: Apr. 16, 2013

(54) SHEET PROCESSING APPARATUS AND IMAGE FORMING APPARATUS

(75) Inventors: Hideki Kushida, Moriya (JP); Kenichi Hayashi, Abiko (JP); Hitoshi Fujimoto, Abiko (JP); Takaharu Hayasaka, Toride (JP); Shigeo Doi, Toride (JP)

(73) Assignee: Canon Kabushiki Kaisha (JP)

( * ) Notice: Subject to any disclaimer, the term of this patent is extended or adjusted under 35 U.S.C. 154(b) by 968 days.

(21) Appl. No.: 12/184,515

(22) Filed: Aug. 1, 2008

(65) Prior Publication Data

US 2009/0035002 A1 Feb. 5, 2009

(30) Foreign Application Priority Data

Aug. 2, 2007 (JP) ..... 2007-201582
Jul. 23, 2008 (JP) ..... 2008-189701

(51) Int. Cl.
*G03G 15/00* (2006.01)

(52) U.S. Cl.
USPC ..... 399/408; 399/53; 399/407; 156/349; 156/350; 156/387

(58) Field of Classification Search ..... 399/53, 399/407, 408; 156/349, 350, 387
See application file for complete search history.

(56) References Cited

U.S. PATENT DOCUMENTS 5,039,652 A * 8/1991 Doll et al. ..... 503/206
5,456,646 A * 10/1995 Crowley ..... 493/187
6,980,767 B1 * 12/2005 Cahill et al. ..... 399/408

FOREIGN PATENT DOCUMENTS

JP 5-185768 A 7/1993
JP 7-1872 A 1/1995
JP 7-299974 A 11/1995

* cited by examiner

*Primary Examiner* — Matthew G Marini
*Assistant Examiner* — Andy Pham
(74) *Attorney, Agent, or Firm* — Rossi, Kimms & McDowell LLP

(57) ABSTRACT

There are provided a sheet processing apparatus and an image forming apparatus which can adjust adhesive strength by a simple configuration.
A toner image for adhesive strength adjustment is formed on a toner image of a sheet to be bonded by an image forming portion provided in a copying machine body. An adhesive is applied onto a bonding portion of the sheet by a gluing device provided in a finisher. The bonding portion of the sheet onto which the adhesive is applied and the toner image having the toner image for adhesive strength adjustment of the sheet are bonded together by a second pushing-out member and a pair of second folding rollers provided in the finisher. The amount of toner forming the toner image for adhesive strength adjustment formed by the image forming portion is adjusted to adjust the adhesive strength of the adhesive.

15 Claims, 21 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus. More specifically, the present invention relates to a sheet processing apparatus and an image forming apparatus which perform a process of bonding sheets having an image formed thereon together with an adhesive.

2. Description of the Related Art

In recent years, there has been an image forming apparatus, such as a copying machine, a printer, or a multiple function processing device of these, has a sheet processing apparatus which bonds sheets, such as paper, resin films, or metal sheets, having an image formed thereon together. As such method of bonding sheets together, a bonding method by applying a liquid adhesive or a dry-type adhesive has been typically performed.

The needs for adhesive strength for bonding sheets together have recently been diverse. A document for a direct mail whose information showing surface is folded in consideration of confidentiality of information requires adhesive strength to a certain extent so as not to open the folded information showing surface against a load during mailing. When its bonding portion is opened by hand, the adhesive strength needs to have a release force so as not to damage the document.

A sheet to be temporality stuck, such as a tag, needs to have a low adhesive strength and to increase releasability. A confidential letter requires a high adhesive strength so as not to easily release its bonding portion. The adhesive strength and releasability need to be different according to the type and application of sheets to be bonded. Each sheet processing apparatus needs to be adjusted so as to correspond to them.

In order to easily adjust such adhesive strength, there have been disclosed a sheet processing apparatus and an image forming apparatus which have between a sheet and an adhesive an adhesive adjusting layer to which an adhesive strength adjusting agent including a very small hard substance is added, the adhesive adjusting layer adjusting adhesive strength (see Japanese Patent Application Laid-Open Nos. 5- and 7-1872).

There has also been disclosed a method of screen printing an adhesive applying surface in the range of 30 to 60% with inks of four colors using a pressure sensitive adhesive and adjusting an exposed area of the pressure sensitive adhesive to adjust adhesive strength (see Japanese Patent Application Laid-Open No. 7-299974).

The sheet processing apparatus and the image forming apparatus of the related art which have the adhesive adjusting layer between the sheet and the adhesive and adjust adhesive strength require a process of inserting an adhesive adjusting sheet applied with the adhesive strength adjusting agent into between the sheet and the adhesive.

The inserting process is assumed to be performed before printing onto the sheet. Thus a joining portion of the adhesive adjusting sheet and the sheet is required upstream of an image forming portion. The pressure sensitive adhesive is used as an adhesive. A folding and pressing portion needs to be provided downstream of the image forming portion.

When the adhesive adjusting sheet is used, it is set upstream of the joining portion. Each time a region on the sheet requiring adhesive strength adjustment or setting of adhesive strength itself is changed, the strength adjusting sheet of different size needs to be prepared so as to be set to the apparatus. There are many other adjusting matters such as changing an insertion timing in the joining portion of the strength adjusting sheet and the sheet.

There are the problems of upsizing the apparatus, increasing the cost thereof, increasing the unit price of a production sheet, specialization of the adhesive, and reduction in production efficiency (in particular, lack of an on-demand production capacity of small-lot production with a wide variety of products to be made).

In the method of printing the adhesive applying surface in the range of 30 to 60% and adjusting the exposed area of the pressure sensitive adhesive to adjust adhesive strength, printing needs to be performed at least after the adhesive is applied.

Here, the relation between the image forming portion and the adhesive will be considered. When a printing method by contacting a printing plate for typical offset printing, relief printing, intaglio printing, stencil printing, or electrophotograph toner with a printed material is used, the possibility that a printing portion may be consumed due to a viscous substance of the adhesive is high. The use of the liquid-type adhesive as an adhesive can lower the printing properties of ink because the ink is printed on the adhesive.

In the method of adjusting adhesive strength by printing the ink onto the adhesive, the usable adhesive is limited to the dry-type pressure sensitive adhesive. When the pressure sensitive adhesive is used, a pressing portion is necessary to give adhesive properties. Upon pressing by the pressing portion, an offset phenomenon which causes the ink to be transferred to the opposite side of a printing surface can occur.

There are the problems of upsizing the apparatus, increasing the cost thereof, increasing the unit price of a production sheet, and specialization of the adhesive.

The present invention provides a sheet processing apparatus and an image forming apparatus which can adjust adhesive strength by a simple configuration.

SUMMARY OF THE INVENTION

The present invention provides an image forming apparatus includes an image forming portion which forms a toner image on a sheet; and a sheet processing apparatus having an adhesive applying portion which applies the adhesive onto a sheet, wherein the toner image formed on the sheet by the image forming portion and a bonding region of the sheet onto which the adhesive is applied by the adhesive applying portion are bonded together.

According to the present invention, the amount of toner of the toner image formed on the portion bonded to the bonding region of the sheet onto which the adhesive is applied is adjusted to adjust adhesive strength of the adhesive. The adhesive strength can be adjusted by a simple configuration.

Further features of the present invention will become apparent from the following description of exemplary embodiments with reference to the attached drawings.

DESCRIPTION OF THE EMBODIMENTS

Exemplary embodiments for carrying out the present invention will be described below in detail using the drawings.

Figure 1:
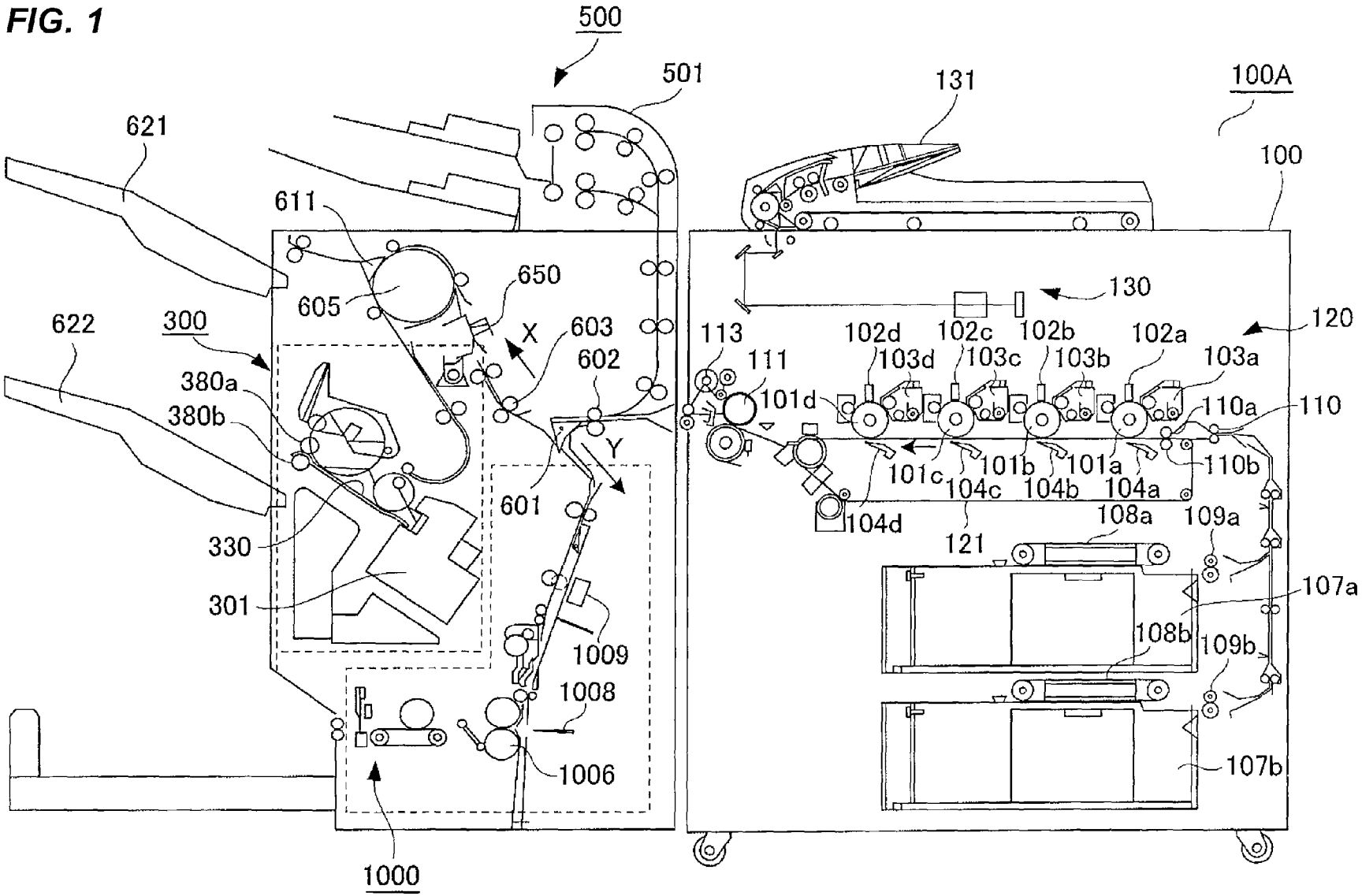
FIG. 1 is a diagram illustrating a configuration of a copying machine which is an example of an image forming apparatus having a sheet processing apparatus according to an embodiment of the present invention.

FIG. 1 is a diagram illustrating a configuration of a copying machine which is an example of an image forming apparatus having a sheet processing apparatus according to an embodiment of the present invention.

In FIG. 1, there are provided a monochrome/color copying machine (hereinafter, referred to as a copying machine) 100A and a copying machine body (image forming apparatus body) 100. The copying machine body 100 has in its upper portion an image reading portion 130 having an original feeding portion 131. The copying machine body 100 has in its inside an image forming portion 120. A finisher 500 as the sheet processing apparatus is connected to the side surface of the copying machine body 100.

The image forming portion 120 is driven by an ultrasonic motor, not illustrated, and has four photosensitive drums 101 (101*a* to 101*d*) which are arranged in parallel and form toner images of colors of yellow, magenta, cyan, and black. Around the photosensitive drums 101*a* to 101*d*, primary chargers 102 (102*a* to 102*d*), development devices 103 (103*a* to 103*d*), and transfer chargers 104 (104*a* to 104*d*) are arranged, respectively.

An exposure device, not illustrated, having an LED is arranged above the photosensitive drums 101. A transfer belt 121 is arranged between the photosensitive drums 101 and the transfer chargers 104 so as to move the length of these.

An image forming operation of the thus configured copying machine 100A will be described.

When the image reading portion 130 reads an original image or print data is transmitted from an external PC 401, the image forming operation is started. In the image forming portion 120, the photosensitive drums 101 are rotatably driven clockwise, whereby the primary chargers 102 give uniform electric charge onto the circumferential surfaces of the photosensitive drums 101. The exposure device, not illustrated, exposes the circumferential surfaces of the photosensitive drums 101 based on the original image information read by the image reading portion 130 or the print data from the external PC 401. Electrostatic latent images are formed on the circumferential surfaces of the photosensitive drums 101.

The electrostatic latent images are developed by the development devices 103. Toner images of four colors of yellow, magenta, cyan, and black are formed on the surfaces of the photosensitive drums.

In parallel with the toner image forming operation, each top sheet of sheets S stored in sheet cassettes 107*a*, 107*b* is loosened and is then picked up by air absorption from a fan communicated with conveying belts 108*a*, 108*b*. The sheets S are conveyed via conveying rollers 109*a*, 109*b* so as to adjust timing by a registration roller 110. The sheets S are guided by a conveying guide so as to be conveyed to a nip portion having a holding roller 110*a* and the transfer belt 121 and are then conveyed on the transfer belt 121.

The holding roller 110*a* is held by a pressing arm, not illustrated, and is urged to the transfer belt by a pressing spring, not illustrated. A backup roller 110*b* is provided across the transfer belt 121 from the holding roller 110*a*.

The sheets S conveyed on the transfer belt 121 are conveyed to a transfer portion where the photosensitive drums 101 and the transfer belt 121 are pressed into contact with each other. In the transfer portion, the toner images of colors of yellow, magenta, cyan, and black on the photosensitive drums 101 are sequentially superposed and transferred on the sheets S by the transfer chargers 104 to which a voltage of opposite-polarity to the toner is applied.

The sheets S onto which the toner images of four colors are multiple-transferred are conveyed into a fixing device 111. The toner images are fixed onto the sheets S by the fixing device 111. The sheets S onto which the toner images are fixed are discharged to the finisher 500 by a pair of discharge rollers 113.

The finisher 500 performs a process of sequentially taking in the sheets discharged from the copying machine body 100 and aligning the taken-in sheets to bundle them, and a process of stapling the rear end of the sheet bundle. The finisher 500 also performs a process of punching the vicinity portions of the rear ends of the taken-in sheets, a sort process, a non-sort process, a saddle stitching process, a folding process, a gluing process, and a sealing process.

The finisher 500 can process the sheets discharged from the copying machine body 100 online. The copying machine body 100 can be used singly because the finisher 500 can be used as an option. The finisher 500 and the copying machine body 100 may be integrated.

The finisher 500 has a pair of inlet rollers 602 which lead the sheets discharged from the copying machine body 100 to the inside thereof. On the downstream side of the pair of inlet rollers 602, there is provided a switching member 601 which selectively guides the sheets to a side stitch bookbinding path X which guides the sheets to a side stitching processing portion 300 or to a saddle stitch bookbinding path Y which guides the sheets to a folding bookbinding processing portion 1000.

The sheets led to the side stitch bookbinding path X by the switching member 601 are fed via a pair of conveying rollers 603 to a buffer roller 605. The buffer roller 605 is a roller which stacks and winds a predetermined number of the sheets fed to its outer circumference. The sheets fed to the buffer roller 605 are stacked on a sample tray 621 by a switching member 611 arranged downstream or are stacked on an intermediate processing tray 330 as a sheet stacking portion in the side stitching processing portion 300.

The sheet bundle stacked on the intermediate processing tray 330 is subjected to the aligning process and the stapling process by a stapler 301, as needed, and is then discharged onto a stack tray 622 by discharge rollers 380*a*, 380*b*.

A punch unit 650 is provided between the pair of conveying rollers 603 and the buffer roller 605. The punch unit 650 is operated, as needed, and punches the vicinity portions of the rear ends of the conveyed sheets.

Figure 2:
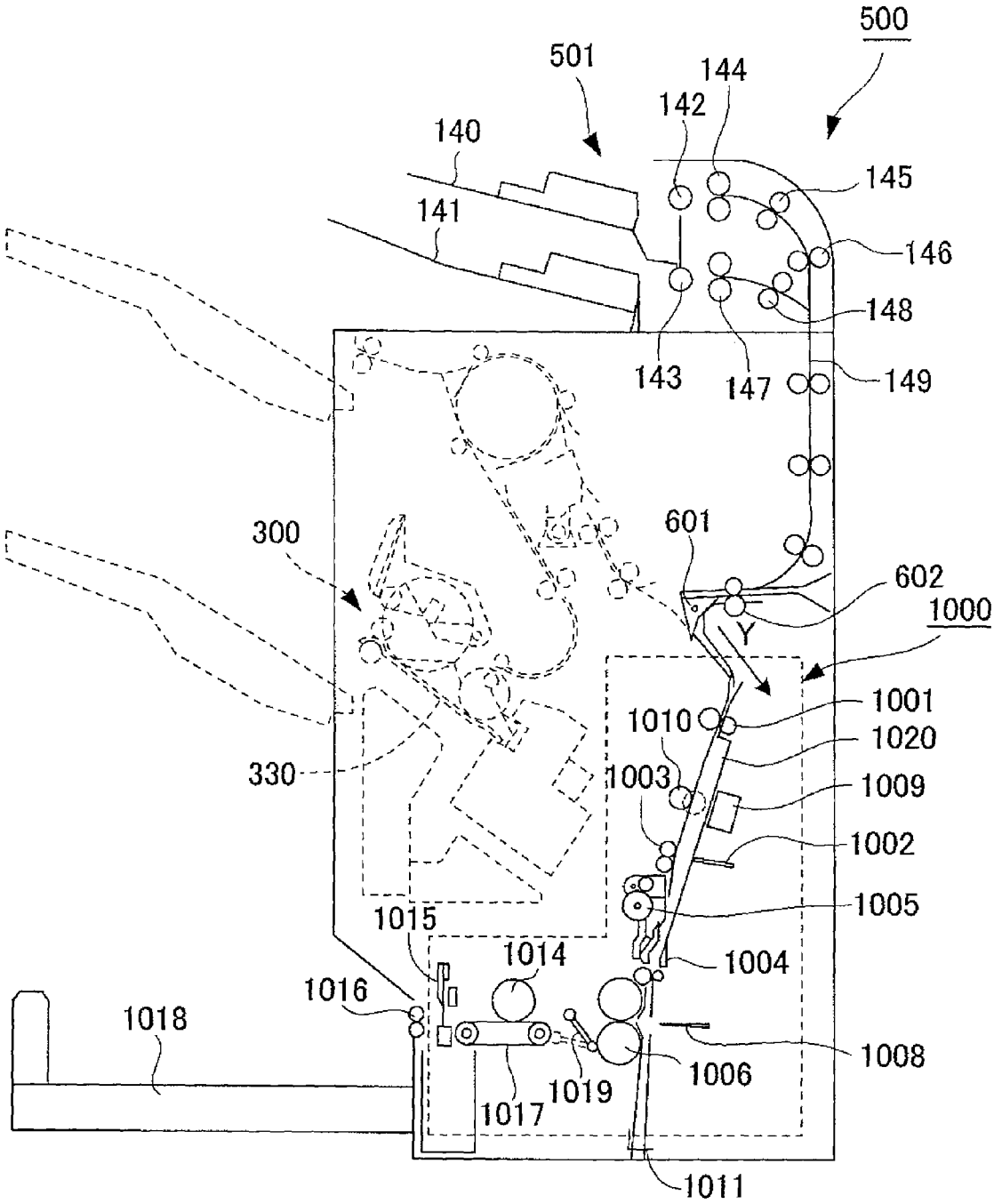
FIG. 2 is a diagram illustrating a configuration of a finisher provided in the copying machine.

The sheets guided to the saddle stitch bookbinding path Y by the switching member 601 are stored in a storage guide 1020 provided in the folding bookbinding processing portion 1000, serves as a folding unit, by a pair of conveying rollers 1001 illustrated in FIG. 2. The sheets are conveyed until their front ends abut a movable sheet positioning member 1011.

The sheets are subjected to the gluing process by a gluing device 1009 and a pressure roller 1010. When the sheets are folded a plurality of number of times, the sheets are folded in a first position by a first folding processing portion composed of a pair of first folding rollers 1003 and a first pushing-out member 1002. After the sheets have been folded by the nip of the pair of first folding rollers 1003, the pair of first folding rollers 1003 are reversely rotated to switch back the sheets for the next process. In the state that the rear ends (upper side portions) of the sheets are temporarily folded, the sheets are returned until the front ends (lower side portions) of the sheets abut the sheet positioning member 1011 of the storage guide.

Two pairs of staplers 1005 are provided midway the storage guide 1020. The sheet bundle is saddle stitched by cooperation of the staplers 1005 and an anvil 1004 opposite the staplers 1005.

In the downstream position of the staplers 1005, there is provided a second folding processing portion having a pair of second folding rollers 1006 and a second pushing-out member 1008 provided opposite the pair of second folding rollers 1006.

The sheet bundle which has been subjected to the gluing process, the first folding process, and the saddle stitching process in the upstream portion is further folded by the second folding processing portion. All the above processes are sequentially performed by lowering the sheet positioning member 1011 by a predetermined distance while regulating the front end positions of the sheets by the sheet positioning member 1011.

The sheet bundle folded by the pair of second folding rollers 1006 is cut at the top and bottom portions thereof (both sides in the conveying direction) by a disc cutter 1014 while the sheet bundle is conveyed by a conveying belt 1017. The edge portion of the sheet bundle is cut by an edge cutter 1015. The sheet bundle is discharged onto a tray 1018 by a discharge roller 1016.

In FIG. 2, an inserter 501 is a device which directly inserts sheets into the intermediate processing tray 330 and the storage guide 1020 without performing the image forming operation. Insert sheets such as a front cover, inserting paper, and a back cover are inserted into the image-formed sheet bundle by the inserter 501. The insert sheets and the image-formed sheets can be saddle stitched or side stitched.

When the insert sheets are inserted into the image-formed sheet bundle by such inserter 501, the insert sheets set to insert sheet trays 140,141 are fed by pickup rollers 142, 143. The insert sheets are conveyed by conveying rollers 144, 145, 147, and 148 and are then pass through an inserter path 149 so as to join the image-formed sheet bundle in the upstream portion of the pair of inlet rollers 602.

For insertion of the front cover, the front cover joins the image-formed sheet bundle in the upstream portion of the pair of inlet rollers 602 at the timing of the front of the bundle. The copying machine body waits for the image forming timing for a time during which the front cover joins the side stitch bookbinding path X, and then conveys the first sheet at insert sheet intervals.

In the same manner, the copying machine body 100 is operated so as to feed the inserting paper and the back cover at insert sheet intervals. All the timings are monitored and controlled with a response signal of a sensor in the conveying path.

Figure 3A:
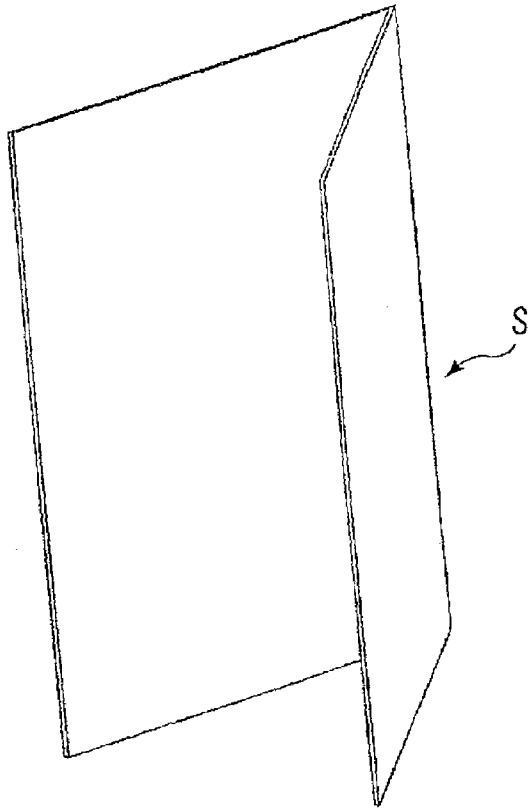
FIGS. 3A and 3B are first diagrams illustrating forms of bookbinding products created in a folding bookbinding processing portion provided in the finisher.
Figure 3B:
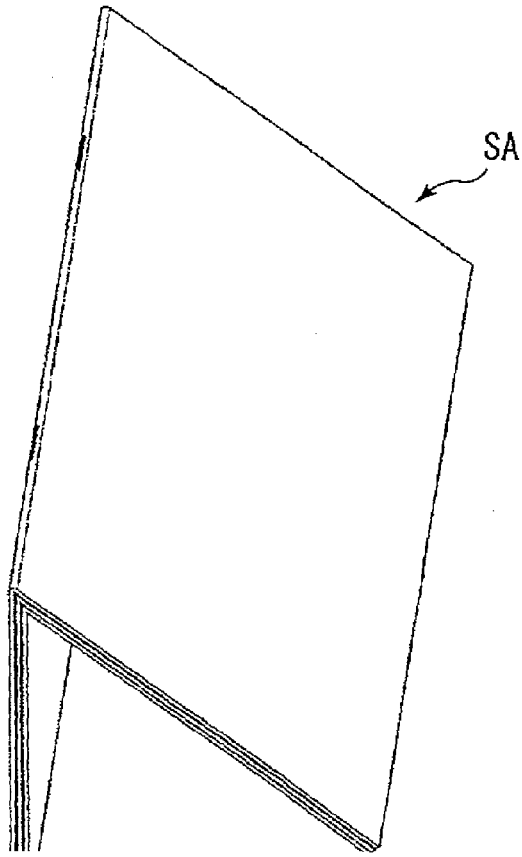
Figure 4A:
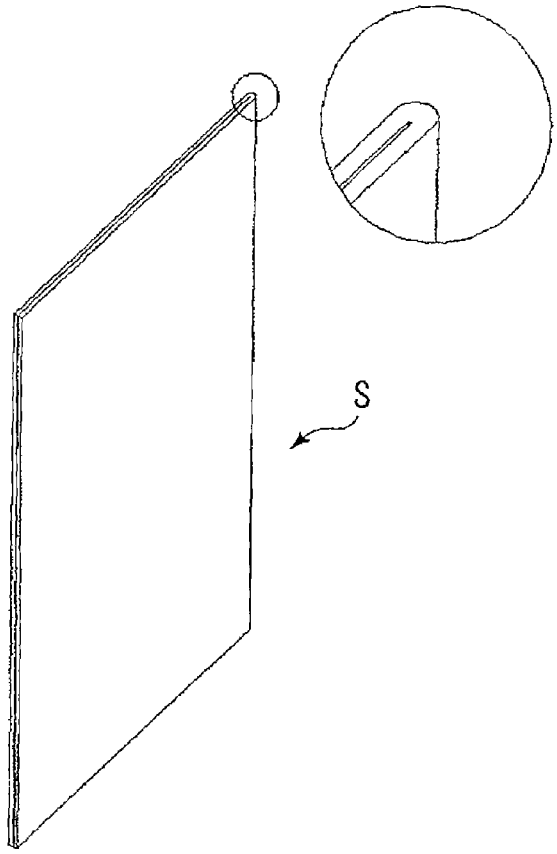
FIGS. 4A and 4B are second diagrams illustrating forms of bookbinding products created in the folding bookbinding processing portion provided in the finisher.
Figure 4B:
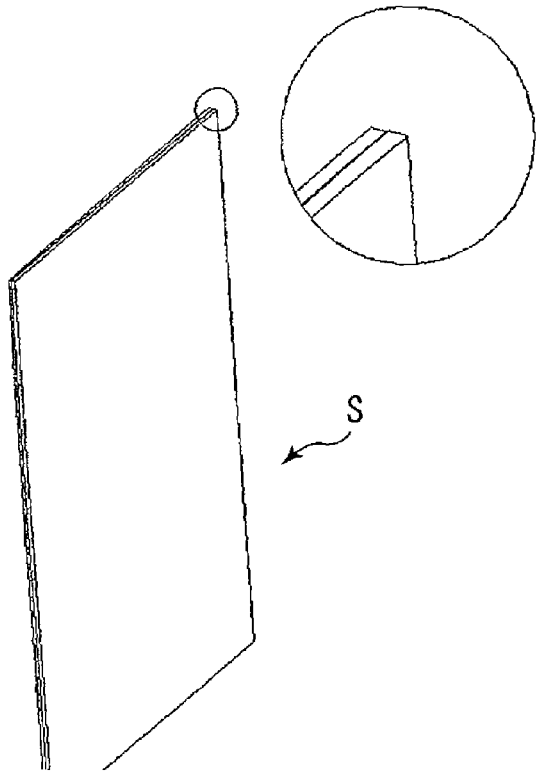

FIGS. 3A, 3B, 4A, 4B, 5A, 5B, and 6 are diagrams illustrating forms of bookbinding products created in such folding bookbinding processing portion 1000. FIG. 3A illustrates the one sheet S folded into two, and FIG. 3B illustrates a saddle stitched sheet bundle SA. FIG. 4A illustrates the sheet S folded into two and sealed on its inside with a glue, and FIG. 4B illustrates the two sheets S bonded together.

Figure 5A:
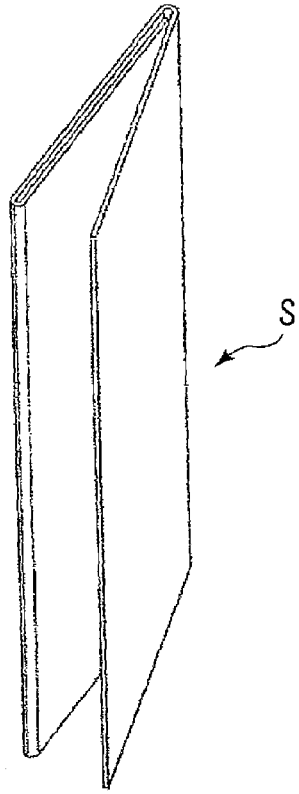
FIGS. 5A and 5B are third diagrams illustrating forms of bookbinding products created in the folding bookbinding processing portion provided in the finisher.
Figure 5B:
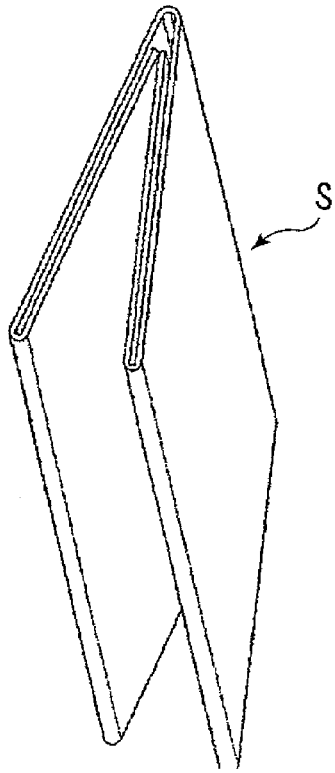

FIG. 5A illustrates the sheet S folded into three, FIG. 5B illustrates the sheet S folded in a double hinged door manner obtained by folding the sheet whose both sides are folded into two, and FIG. 6A illustrates the sheet bundle SA sealed so as to enclose its cover, that is, saddle stitched. Other than such forms, if "gluing", "folding", and "binding" are combined, sheet processed documents in various forms can be created.

Figure 7:
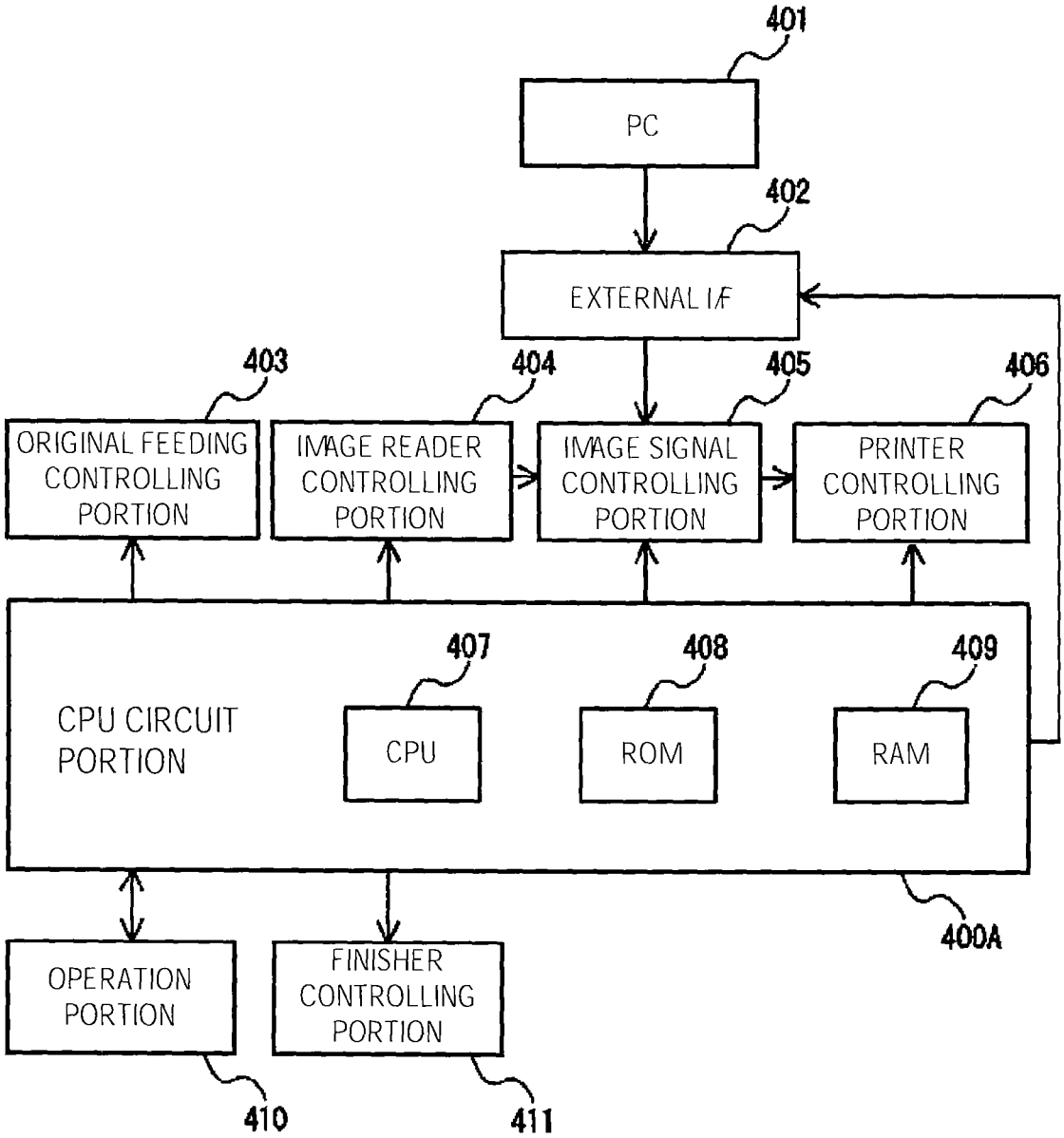
FIG. 7 is a control block diagram of the copying machine.

FIG. 7 is a control block diagram of the copying machine 10A. A CPU circuit portion 400A has a CPU 407, a ROM 408 which stores a control program, and a RAM 409 used as a region which temporarily holds control data and a working region of computation with control.

In FIG. 7, an external I/F (interface) is an interface between the copying machine 100A and the external PC 401. When the external I/F 402 receives print data from the PC 401, it develops the data to a bitmap image and then outputs it as image data to an image signal controlling portion 405.

The image signal controlling portion 405 outputs the data to a printer controlling portion 406. The printer controlling portion 406 outputs the data from the image signal controlling portion 405 to an exposure controlling portion, not illustrated. The original image read by the image sensor (see FIG. 1) is outputted from an image reader controlling portion 404 to the image signal controlling portion 405. The image signal controlling portion 405 outputs the image output to the printer controlling portion 406.

An operation portion 410 has a plurality of keys which set various functions about image formation, and a displaying portion which displays a set state. The operation portion 410 outputs a key signal corresponding to operation of each of the keys by a user to the CPU circuit portion 400A, and displays corresponding information on the displaying portion based on a signal from the CPU circuit portion 400A.

The CPU circuit portion 400A controls the image signal controlling portion 405 according to the control program stored in the ROM 408 and setting of the operation portion 410, and controls the original feeding portion 131 via an original feeding controlling portion 403.

Figure 8:
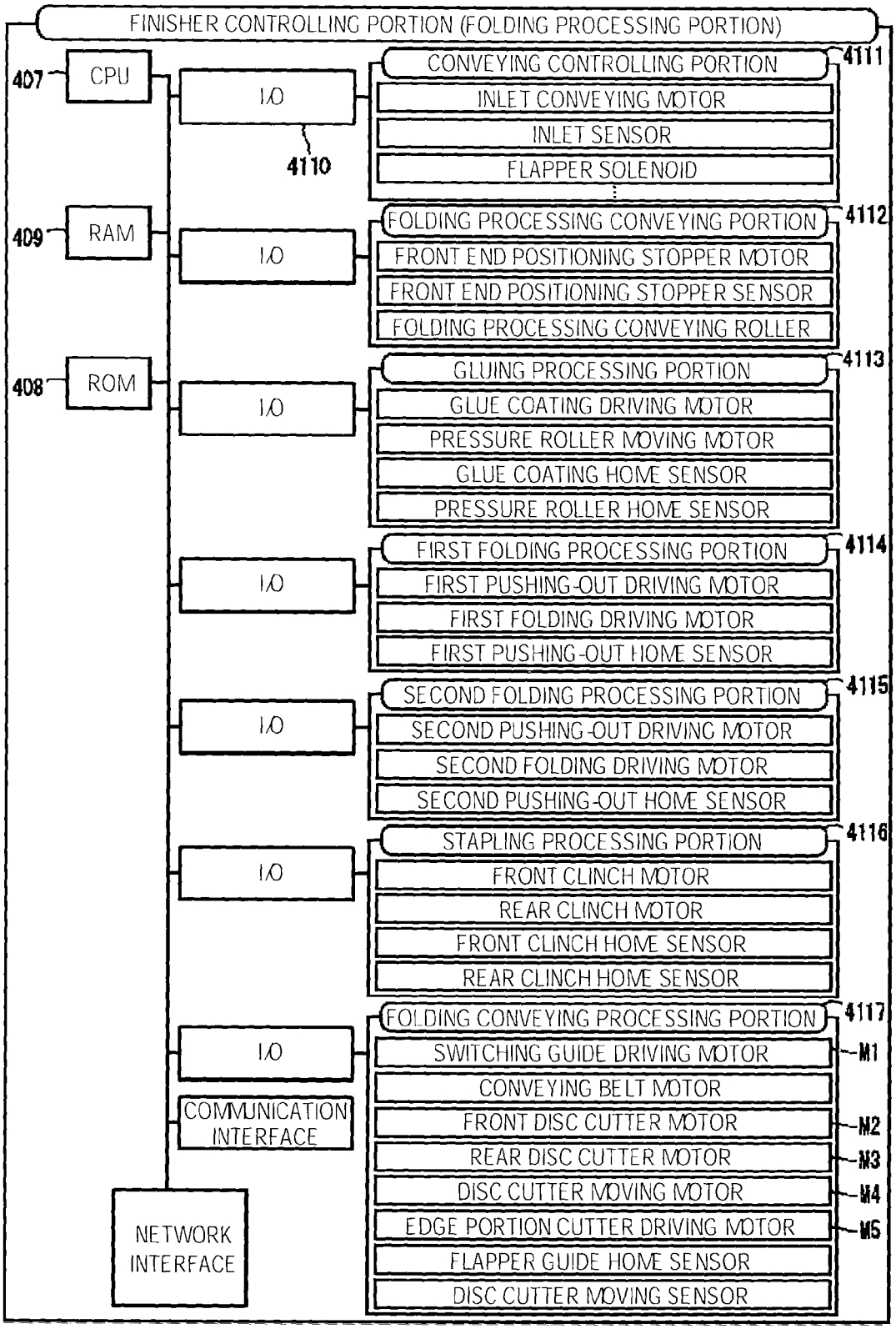
FIG. 8 is a control block diagram of a finisher controlling portion provided in the finisher.

The CPU circuit portion 400A controls the image reading portion (image reader portion) 103 via the image reader controlling portion 404 and the image forming portion 120 via the printer controlling portion 406, respectively. As illustrated in FIG. 8, the side stitching processing portion 300 and the folding bookbinding processing portion 1000 provided in the finisher 500 are controlled via a finisher controlling portion 411.

The CPU circuit portion 400A controls the finisher controlling portion 411 based on the processing mode inputted and set by the PC 401 or the operation portion 410. FIG. 8 is a control block diagram of the finisher controlling portion 411. The finisher controlling portion 411 controls a conveying controlling portion 4111 which controls conveying of the sheet, a folding processing conveying portion 4112, and a gluing processing portion 4113 via an I/O 4110.

The finisher controlling portion 411 also controls a first folding processing portion 4114, a second folding processing portion 4115, a stapling processing portion 4116, and a folding conveying processing portion 4117 via the I/O 4110.

The relation between the toner image and the release force will be described using FIGS. 9A to 9C.

Figure 9A:
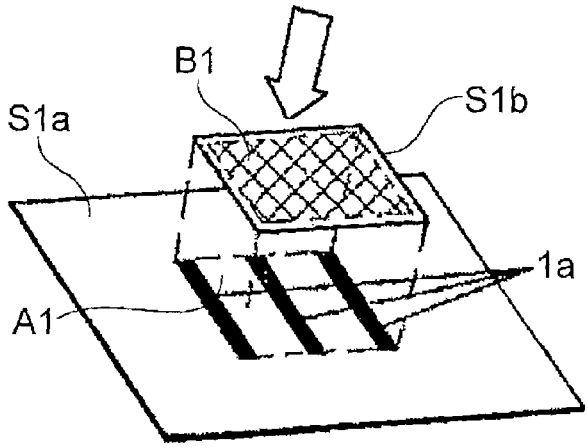
FIGS. 9A, 9B, and 9C are diagrams illustrating a bonding method in the finisher.
Figure 9B:
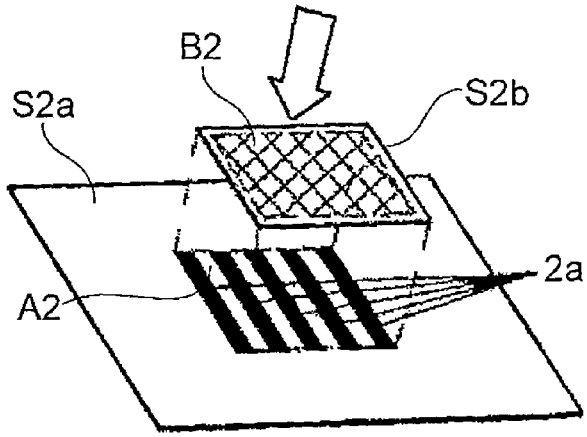
Figure 9C:
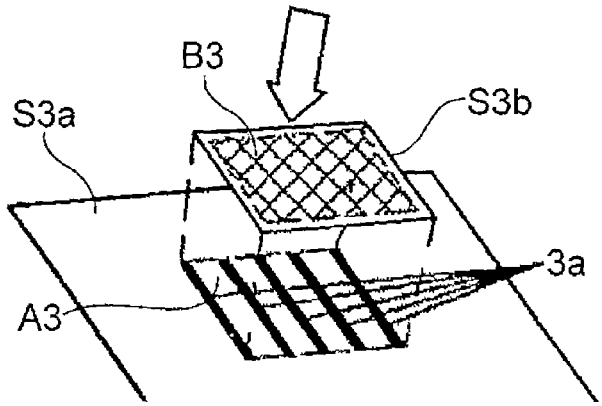

In FIGS. 9A to 9C, S1*a* to S3*a* are sheets such as a postcard, flat paper, an envelope, and continuous forms paper, which can form an image by a copying machine, a printer, or a facsimile using electrophotography which typically transfers the toner image.

As illustrated in FIGS. 9A to 9C, the sheets S1*a* to S3*a* have bonding regions (toner image portions) A1 to A3. Toner images 1*a* to 3*a* are formed on the bonding regions A1 to A3.

Sheets S1*b* to S3*b* are bonded to the sheets S1*a* to S3*a*, and have a characteristic equal to that of the sheets S1*a* to S3*a* and regions (bonding regions) B1 to B3 onto which an adhesive such as a spray glue, a solid glue, or a liquid glue, is applied. The adhesive is applied onto the regions B1 to B3. The sheets S1*b*to S3*b* are bonded to the sheets S1*a* to S3*a* manually or a sheet bonding device, not illustrated, in the direction of arrow.

FIGS. 9A and 9B will be compared. The toner image 2*a* of FIG. 9B having an area larger (e.g., about 1.6 times) than that of the toner image 1*a* of FIG. 9A is fixed to the bonding region A2. The toner image 3*a* of FIG. 9C having a line narrower than that of the toner image 2*a* of FIG. 9B is formed.

Figure 10A:
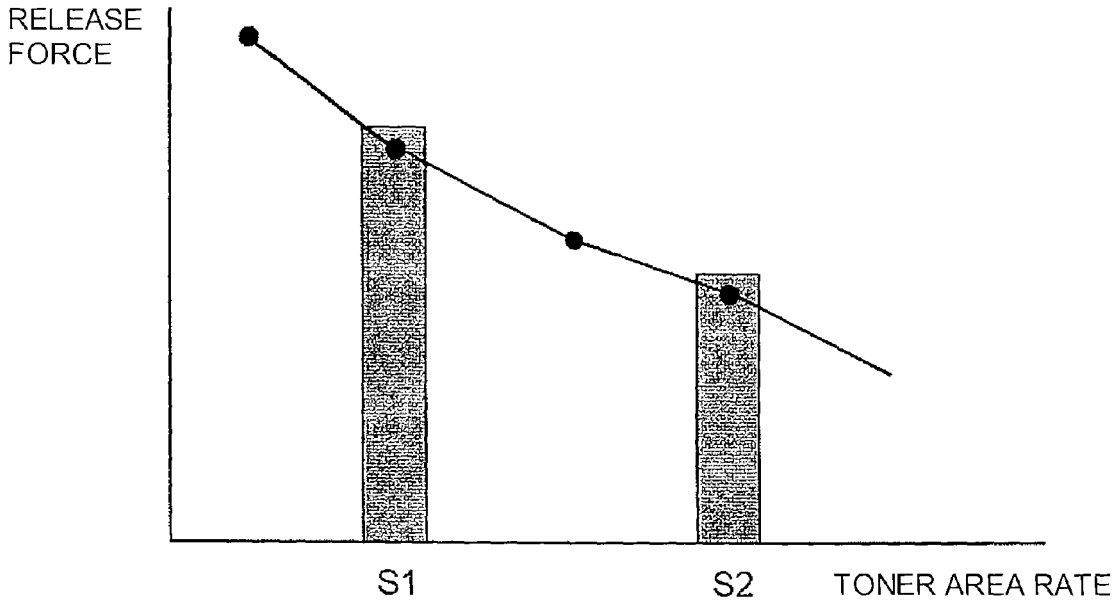
FIG. 10A is a diagram illustrating the relation between the release force and the toner area in the bonding method.

FIG. 10A is a graph (diagram) illustrating the relation between the release forces and the toner area rate occupied on the bonding surfaces of the sheet S1*b* and the sheet S2*b*. As illustrated in the graph, as the toner area rate occupied on the bonding surface is increased, the release force becomes smaller.

This is caused by the surface properties of the toner image, a wax ingredient contained in the toner, and a silicone oil ingredient adhered at fixing. This is because the adhesive strength of the adhesive is changed between the toner image and the non-toner image. The release force of the sheet S1*a* of FIG. 9A is larger than the release force of the sheet S2*a* of FIG. 9B, because a toner image area the sheet S1*a* having a small number of the line is smaller than that of the sheet S2*a*. The release force of the sheet S3*a* of FIG. 9C is smaller than the release force of the sheet S2*a* of FIG. 9B, because the line of the toner image 3*a*is narrower than that of the toner image 2*a*.

Figure 10B:
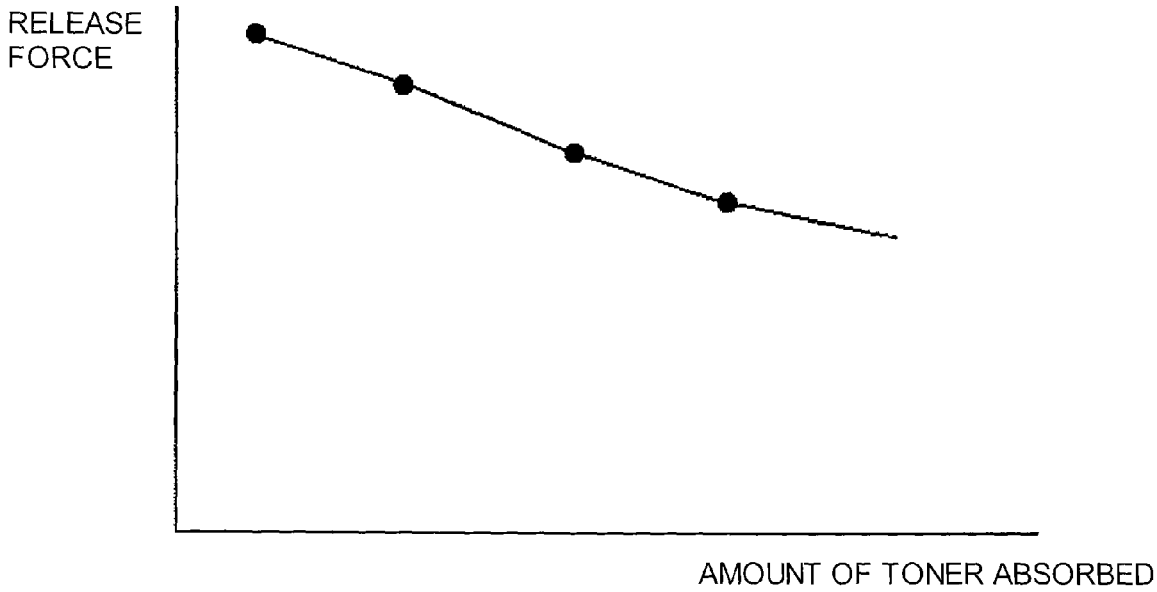
FIG. 10B is a diagram illustrating the relation between the release force and the amount of toner absorbed in the bonding method.

FIG. 10B is a graph (diagram) illustrating the relation between the amount of toner absorbed in the image and the release force by making the occupied areas of the toner image uniform. As illustrated in the graph, as the amount of toner absorbed is increased, the release force becomes smaller.

This is because the improvement in the surface properties by superposed coating of the toner image and increase in the amount of the wax ingredient contribute to the change of the adhesive strength.

The release force (adhesive strength) of the sheet can be adjusted according to the amount of toner forming the toner image. In this embodiment, the CPU circuit portion 400A as a controller controls the toner image forming operation for adhesive strength adjustment by the image forming portion 120 as the toner image forming portion which forms the toner image for adhesive strength adjustment while adjusting the amount of toner via the printer controlling portion 406.

Specifically, the CPU circuit portion 400A controls the image forming portion 120 and then, in order to adjust the adhesive strength of the adhesive, adjusts the forming area of the toner image for adhesive strength adjustment formed by the image forming portion 120 or adjusts the amount of toner (the amount of toner absorbed) per unit area of the toner image for adhesive strength adjustment.

There will be described a sheet bonding method in the folding bookbinding processing portion 1000 so as to adjust the adhesive strength according to the amount of toner forming the toner image on the sheet.

Figure 6:
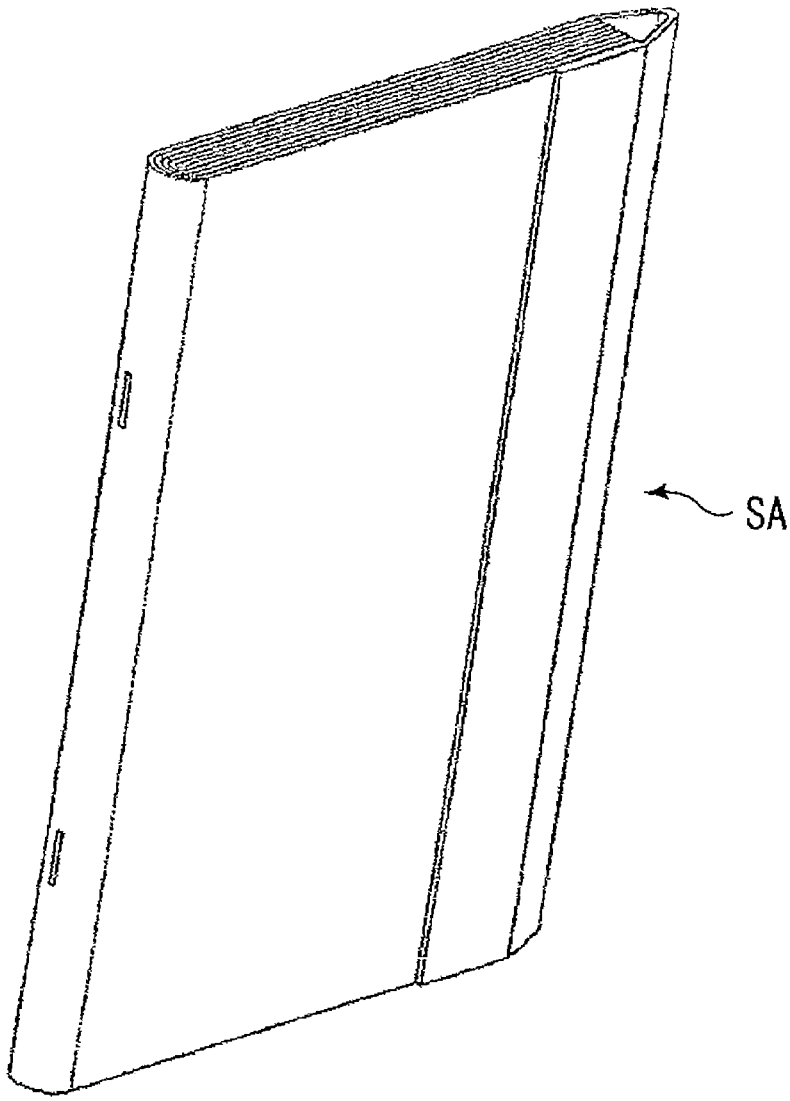
FIG. 6 is a fourth diagram illustrating a form of a bookbinding product created in the folding bookbinding processing portion provided in the finisher.

The sheet bonding method will be described by way of creation of the sheet illustrated in FIG. 4A, folded into two, and sealed on its inside with the glue and the saddle stitched sheet bundle SA illustrated in FIG. 6 sealed so as to enclose its cover. In FIG. 4A, the sheet is folded into two with a surface describing a payment statement or personal information inside and is a confidential document needing to hide the described matters therein by increasing the bonding strength of the glue. In FIG. 6, the sheet bundle SA is a saddle stitched product which has seal/open properties according to its cover and is a document which has rather not-so-high confidentiality and is desired to be opened/sealed over and over again.

In this embodiment, the two documents can be realized by the finisher 500 as the sheet processing apparatus without changing the type of the glue.

There will be described an operation for creating the sheet folded into two and sealed on its inside with the glue.

Figure 11A:
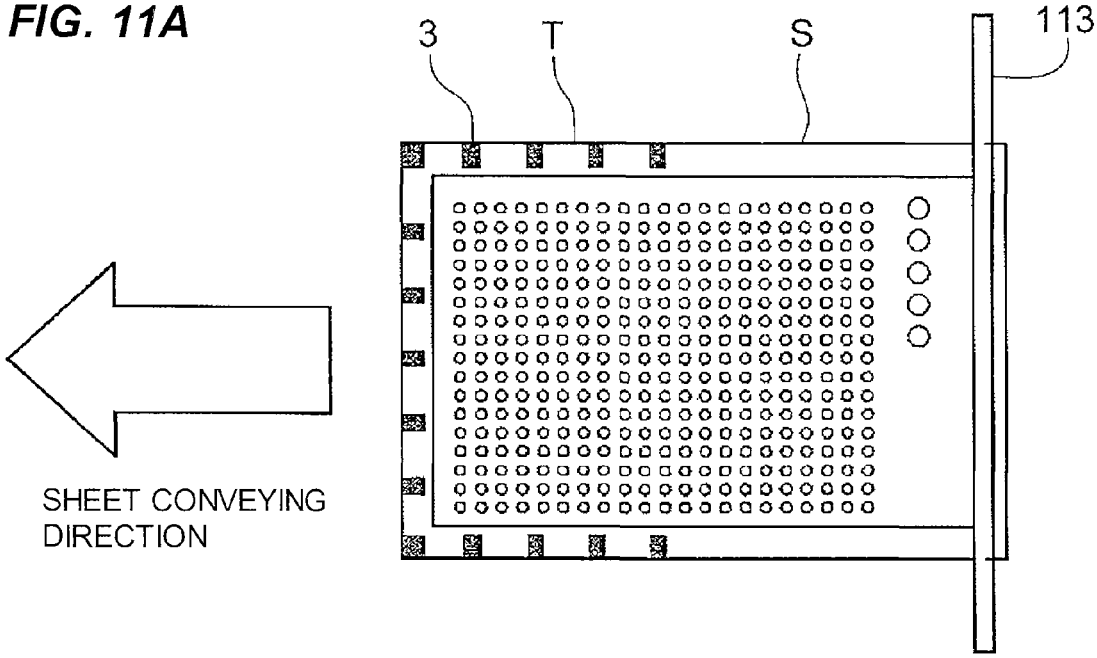
FIGS. 11A and 11B are first diagrams illustrating an operation of the sheet processing apparatus which creates a sheet folded into two and sealed on its inside with a glue.

The "bookbinding form", "gluing position", and "gluing strength" are set to the operation portion 410 (see FIG. 7) provided in the copying machine body 100 to start a print output operation. As illustrated in FIG. 11A, a sheet surface having the toner images 3 for adhesive strength adjustment other than a text (normal recorded portion) on a peripheral portion T of the sheet S is formed by the copying machine body 100.

Figure 11B:
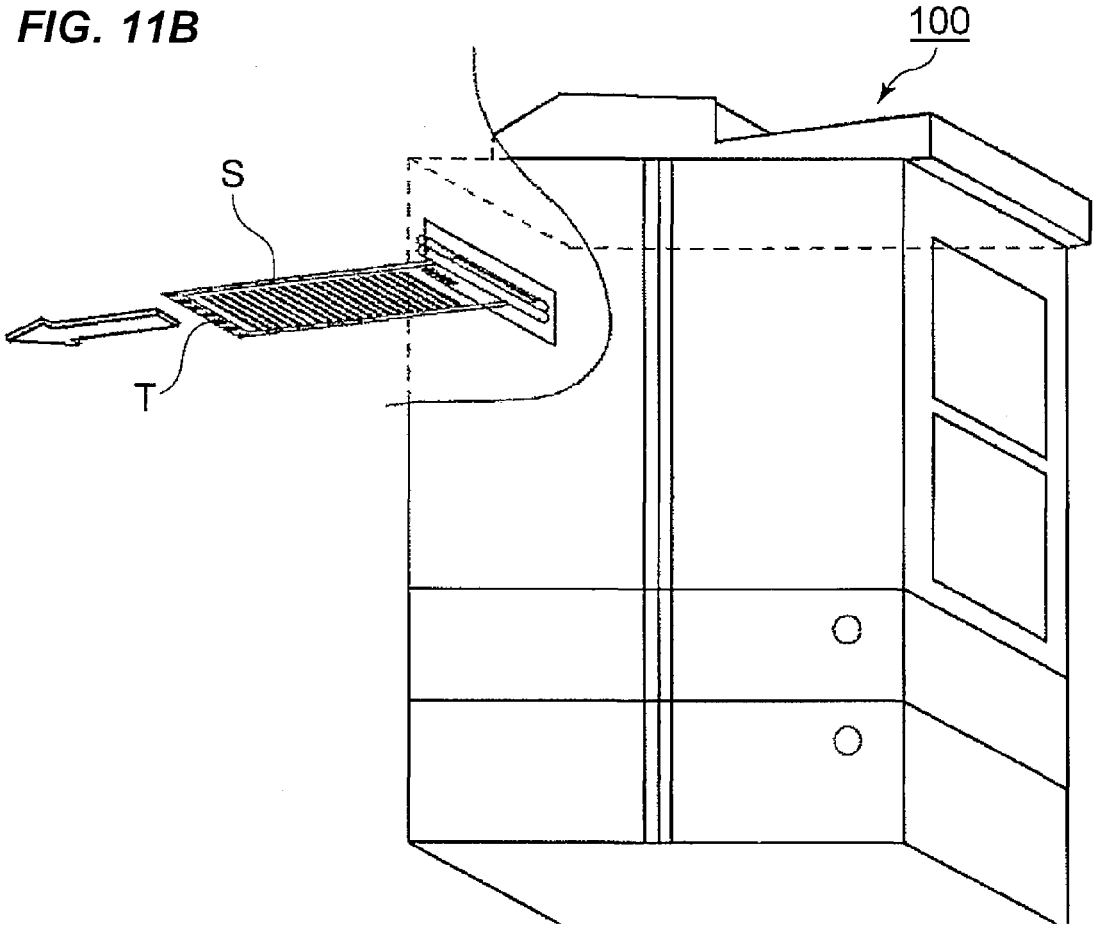
Figure 12A:
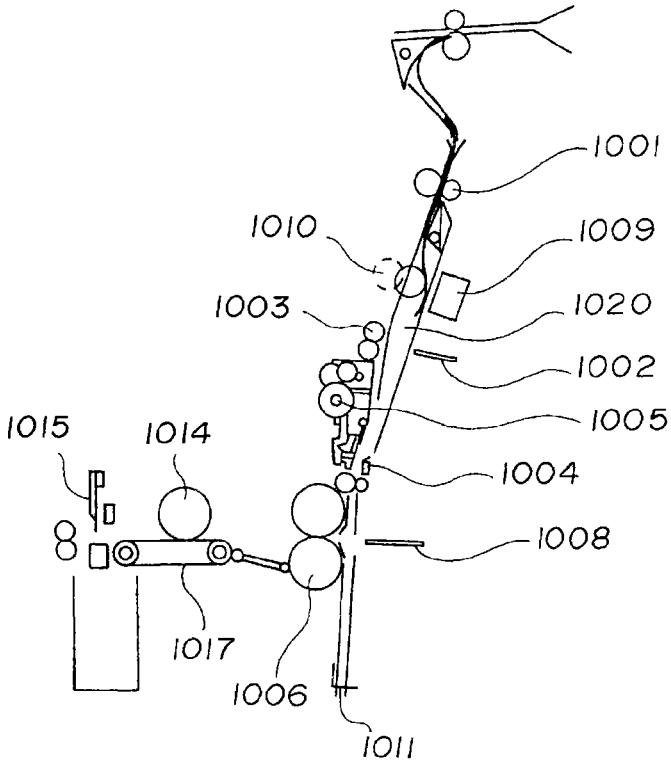
FIGS. 12A and 12B are second diagrams illustrating an operation of the sheet processing apparatus which creates a sheet folded into two and sealed on its inside with a glue.

As illustrated in FIG. 11B, the sheet S is discharged from the copying machine body 100 so that the sheet surface having the toner images 3 thereon is on the lower side. The sheet S is then led to the folding bookbinding processing portion 1000 of the finisher 500. As illustrated in FIG. 12A, the sheet S is stored in the storage guide 1020 of the folding bookbinding processing portion 1000.

Figure 12B:
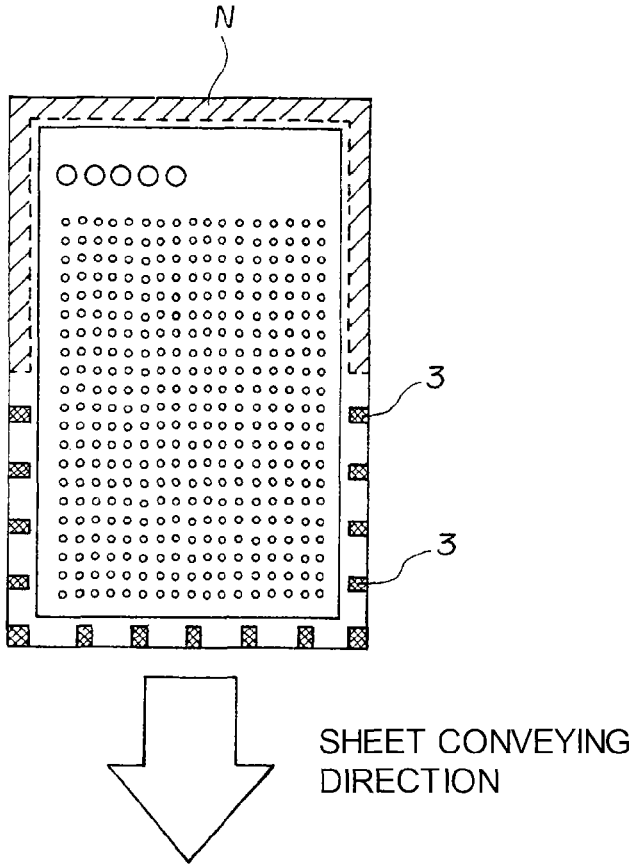

When the sheet S is passed up to a predetermined position, the pressure roller 1010 typically located in a standby position indicated by the dashed line is moved to the gluing device. The sheet S is conveyed while being gripped by the pressure roller 1010 and the gluing device 1009. The slant lines region at the rear end of the sheet S illustrated in FIG. 12B is subjected to the gluing process by the gluing device 1009 configuring the adhesive applying portion together with the pressure roller 1010. A gluing portion N as a bonding region of the sheet S is formed.

Figure 13A:
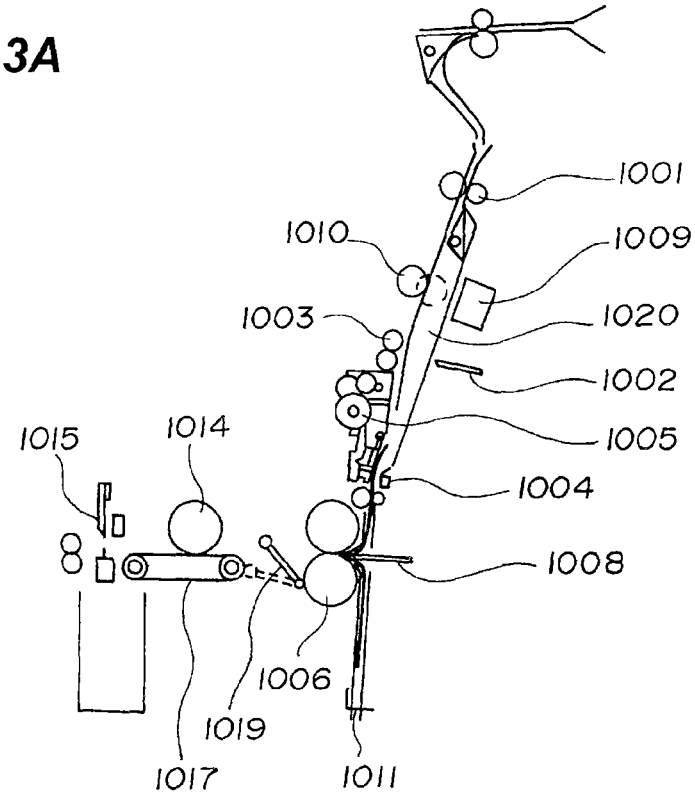
FIGS. 13A and 13B are third diagrams illustrating an operation of the sheet processing apparatus which creates a sheet folded into two and sealed on its inside with a glue.

As illustrated in FIG. 13A, the sheet S having the gluing portion N is moved up to a height at which the center portion of the sheet and a nip portion of the pair of second folding rollers 1006 coincide with each other by the sheet positioning member 1011. During this, the conveying roller, not illustrated, is moved away from the gluing portion N with passage thereof. The adhesion of the glue of the gluing portion N to the surface of the roller can be prevented.

Figure 13B:
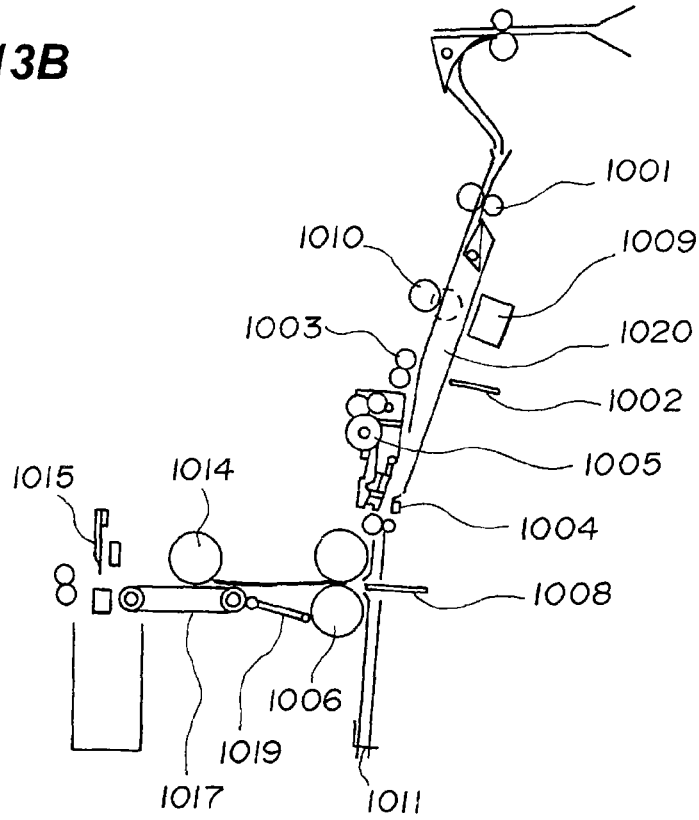

As illustrated in FIG. 13B, the sheet S whose center portion is pushed out by the second pushing-out member 1008 is folded by the pair of second folding rollers 1006. The sheet surface having the toner images 3 on the peripheral portion T illustrated in FIG. 11A on the release side opposite the folding portion of the sheet S is bonded to the gluing portion N illustrated in FIG. 12B.

The sheet S in which the gluing portion N and the portion of the sheet having the toner image 3 for adhesive strength adjustment are bonded together by the second pushing-out member 1008 and the pair of second folding rollers 1006 as the sheet bonding portion is conveyed by the conveying belt 1017.

Figure 14A:
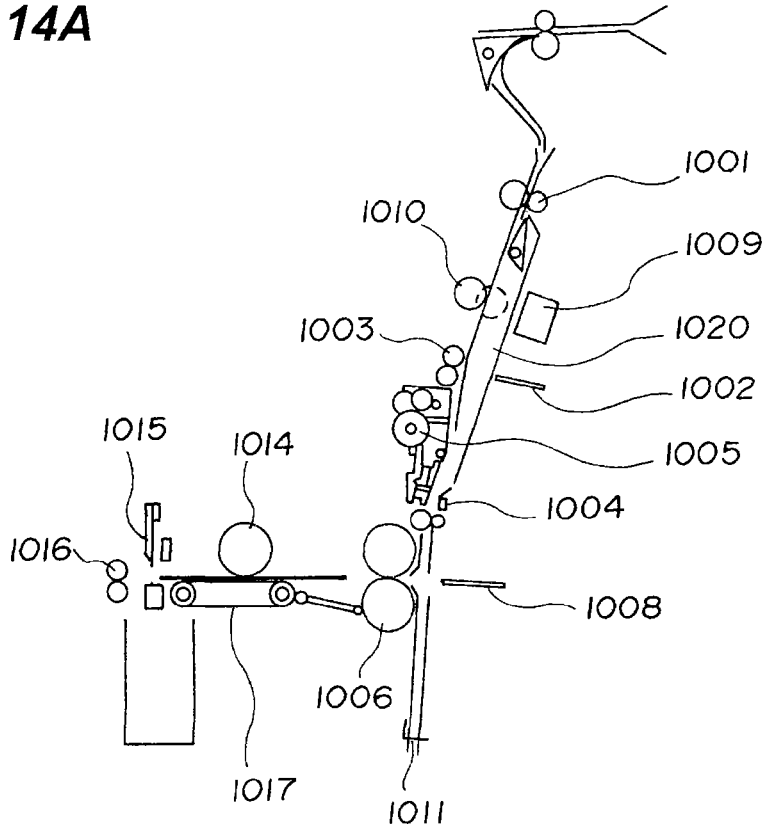
FIGS. 14A and 14B are fourth diagrams illustrating an operation of the sheet processing apparatus which creates a sheet folded into two and sealed on its inside with a glue.
Figure 14B:
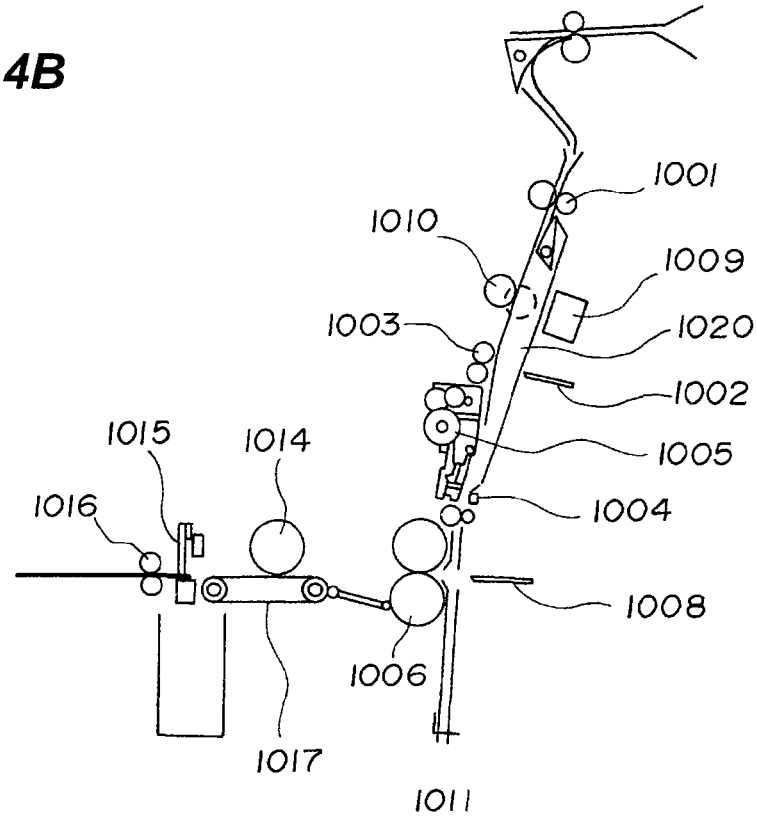

While the sheet S is conveyed by the conveying belt 1017, as illustrated in FIG. 14A, the top and bottom portions of the sheet S are cut by the disc cutter 1014 which has been moved so as to coincide with a register mark position. The sheet S is then conveyed by the conveying belt 1017 and the discharge roller 1016. As illustrated in FIG. 14B, the edge portion of the sheet S is cut by the edge cutter 1015.

After such bookbinding, the discharged product (see FIG. 4A) has a very high adhesive strength of the glue and cannot be easily released. The product in this state can be used as a confidential document. In some cases, slits are provided in three sides other than the fold by a perforating device provided offline, which can enhance the open properties. The adhesive strength can be changed by varying the area of the toner image.

The bookbinding product of FIG. 4B is obtained by cutting the folding portion of FIG. 4A by the edge cutter 1015. The bookbinding product of FIG. 4B may be obtained by the two sheets, one single sheet on which the toner image is formed, and other sheet on which the bonding region is formed. And the bookbinding product of FIG. 4B may be obtained by the two sheets, both the sheets on which the toner image and the bonding region are formed corresponding to each other.

There will be described an operation of creating the saddle stitched sheet bundle SA illustrated in FIG. 6 having seal/open properties according to its cover sheet.

The "bookbinding form", "gluing position", and "gluing strength" are set by the operation portion 410 which is an inputting portion specifying the magnitude of the adhesive strength of the adhesive provided in the copying machine body 100 to start the print output operation. Images are sequentially formed on the sheets by the copying machine body 100. The sheets are then sequentially led into the storage guide 1020 of the folding bookbinding processing portion 1000 of the finisher 500.

Figure 15:
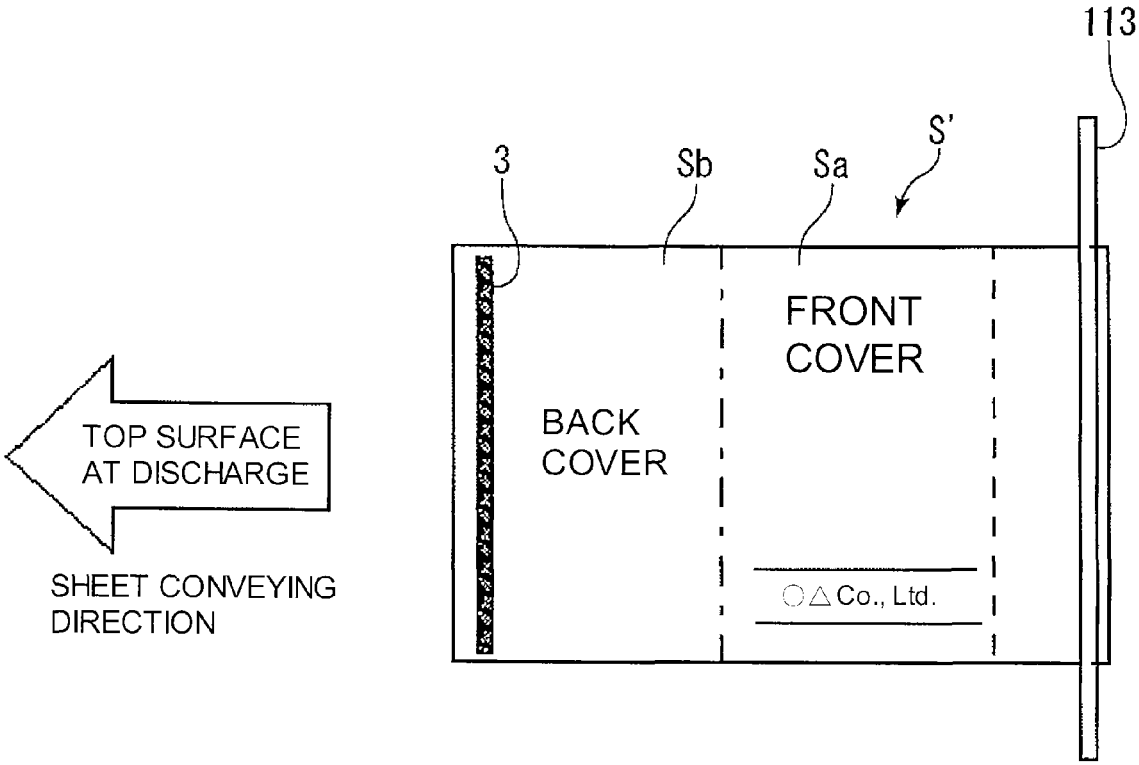
FIG. 15 is a first diagram illustrating an operation of the sheet processing apparatus which creates a saddle stitched sheet bundle.

As illustrated in FIG. 15, the toner image 3 for adhesive strength adjustment is formed on a portion Sb which is the back cover of a surface sheet S' in which the front cover and the back cover enclosing the sheets sequentially led into the storage guide 1020 are integrated. In FIG. 15, a portion Sa is the front cover of the sheet bundle enclosed by the surface sheet S'.

Figure 16A:
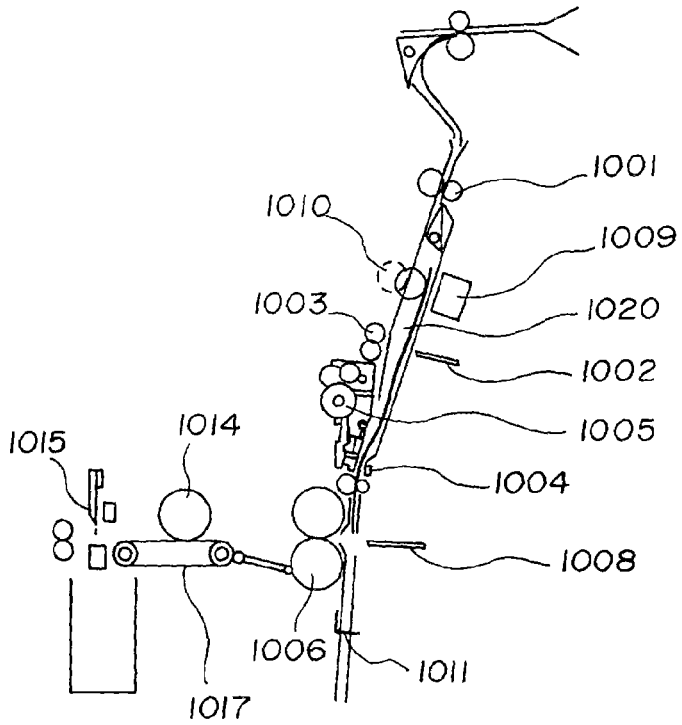
FIGS. 16A and 16B are second diagrams illustrating an operation of the sheet processing apparatus which creates a saddle stitched sheet bundle.

The surface sheet S' is discharged from the copying machine body 100 so that its front cover is on the upper side and is then stored in the storage guide 1020 of the folding bookbinding processing portion 1000. When the surface sheet S' is passed up to a predetermined position, the pressure roller 1010 located in a standby position illustrated in FIG. 16A is moved to the gluing device.

Figure 16B:
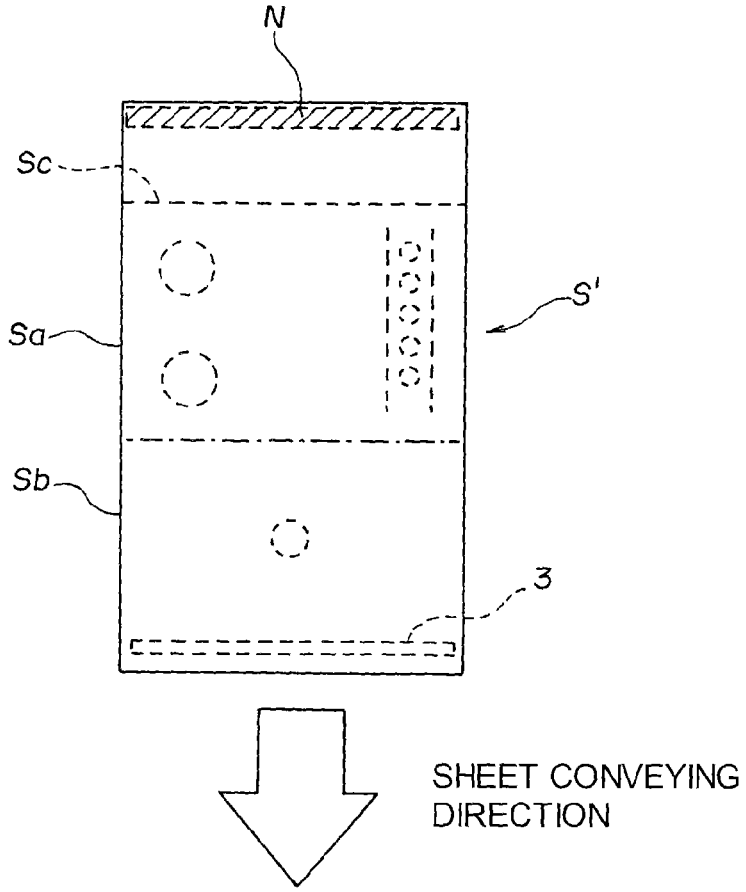

The surface sheet S' is conveyed while being gripped by the pressure roller 1010 and the gluing device 1009. As illustrated in FIG. 16B, the slanted lines region at the rear end of the surface opposite the front cover of the surface sheet S' is subjected to the gluing process by the gluing device 1009, thereby forming the gluing portion N.

Figure 17A:
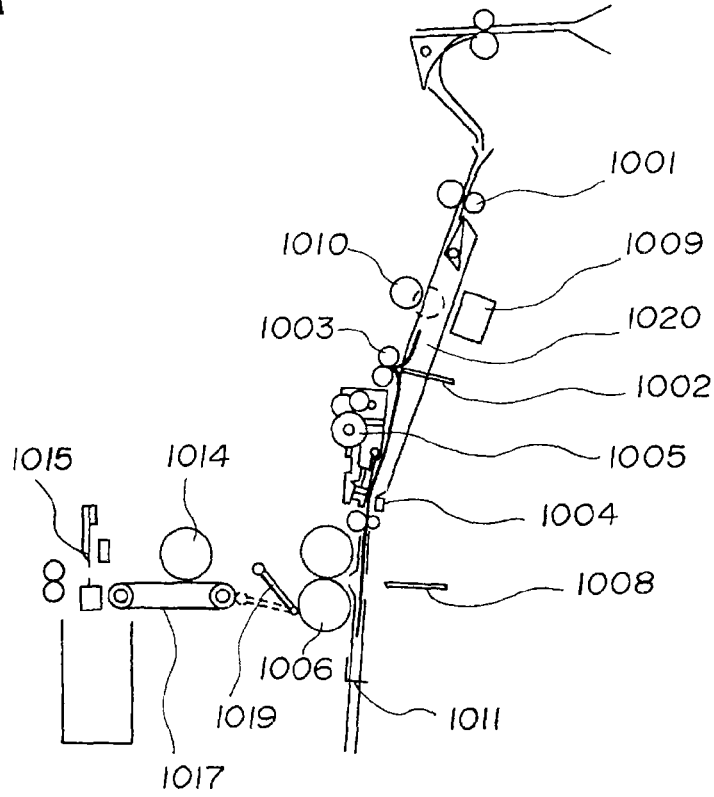
FIGS. 17A and 17B are third diagrams illustrating an operation of the sheet processing apparatus which creates a saddle stitched sheet bundle.
Figure 17B:
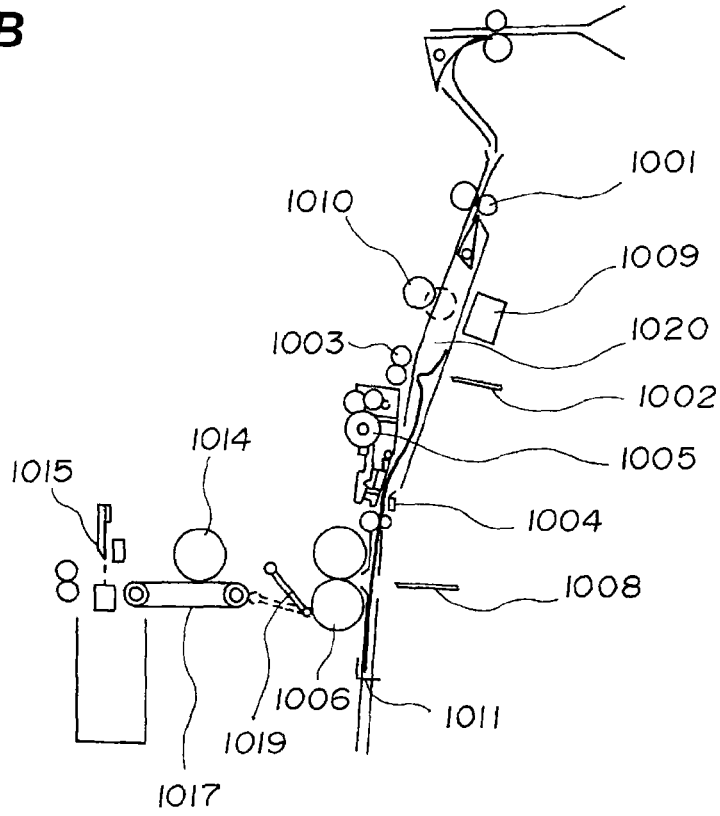

As illustrated in FIG. 17A, a dashed line portion Sc of the front cover Sa illustrated in FIG. 16B of the surface sheet S' having the gluing portion N is folded by the pair of first folding rollers 1003 and the first pushing-out member 1002. After such folding process, the cover sheet S' is switched back for the next process. As illustrated in FIG. 17B, the cover sheet S' is returned until the front end thereof abuts the sheet positioning member 1011 of the storage guide.

Figure 18A:
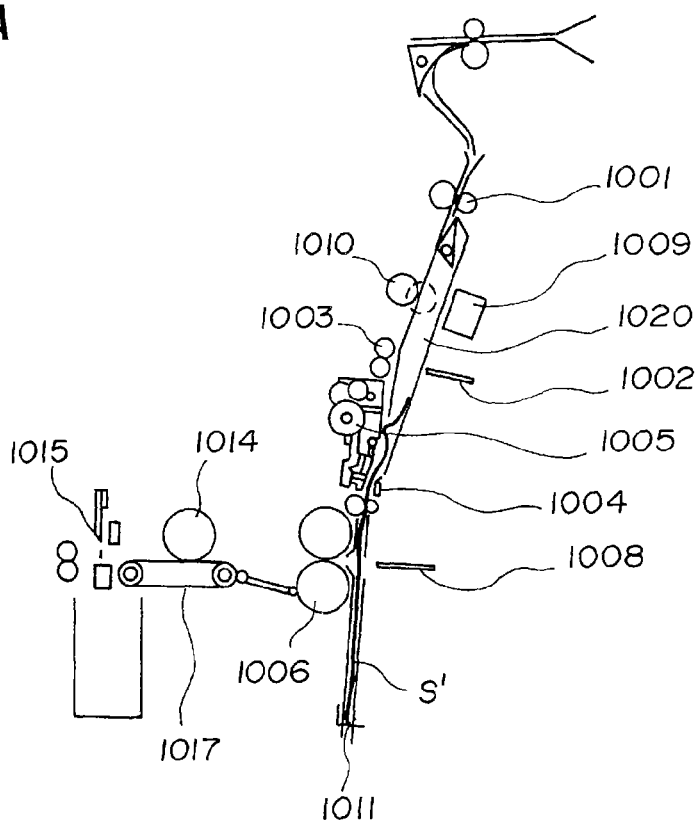
FIGS. 18A and 18B are fourth diagrams illustrating an operation of the sheet processing apparatus which creates a saddle stitched sheet bundle.

The cover sheet S' returned until it abuts the sheet positioning member 1011 and the contents sheets which have abut the sheet positioning member 1011 are aligned. After the alignment is completed, as illustrated in FIG. 18A, the cover sheet S' and the contents sheets are saddle stitched by the stapler 1005 in the center portion of the contents sheets. The saddle stitched sheet bundle is moved by the sheet positioning member 1011 up to a height at which the center portion of the contents sheets and the nip portion of the pair of second folding rollers 1006 coincide with each other.

Figure 18B:
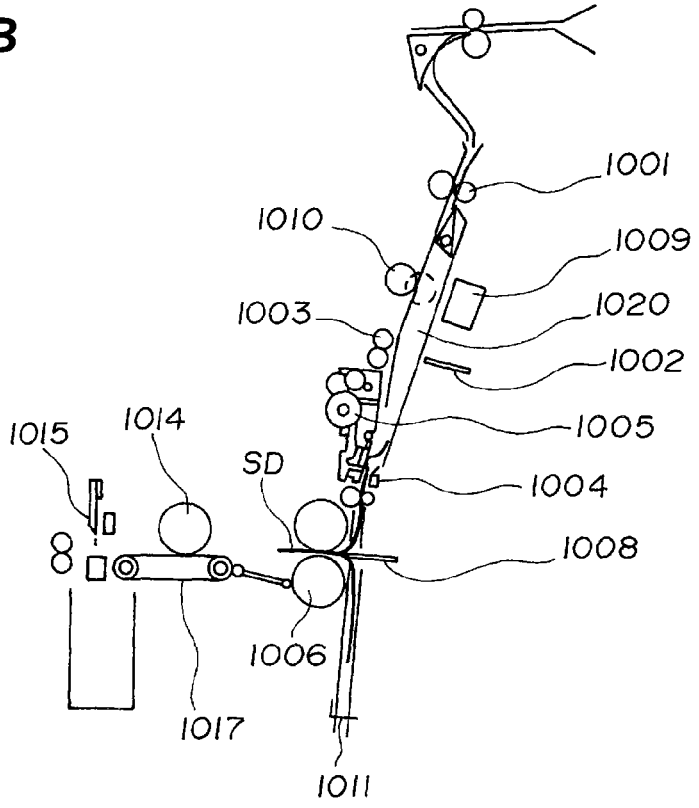
Figure 19A:
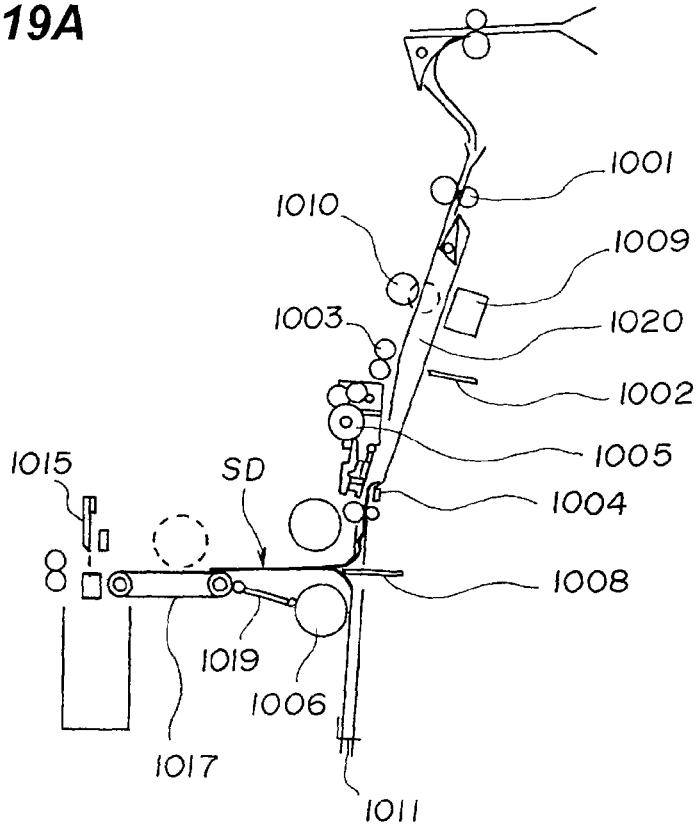
FIGS. 19A and 19B are fifth diagrams illustrating an operation of the sheet processing apparatus which creates a saddle stitched sheet bundle.

As illustrated in FIG. 18B, a sheet bundle SD whose center portion is pushed out by the second pushing-out member 1008 is folded by the pair of second folding rollers 1006. The folding portion of the sheet bundle SD passes through the pair of second folding rollers 1006. As illustrated in FIG. 19A, the pair of second folding rollers 1006 are moved away from each other in the upper and lower directions in the position where the front portion of the sheet bundle SD is moved onto the conveying belt 1017.

Figure 19B:
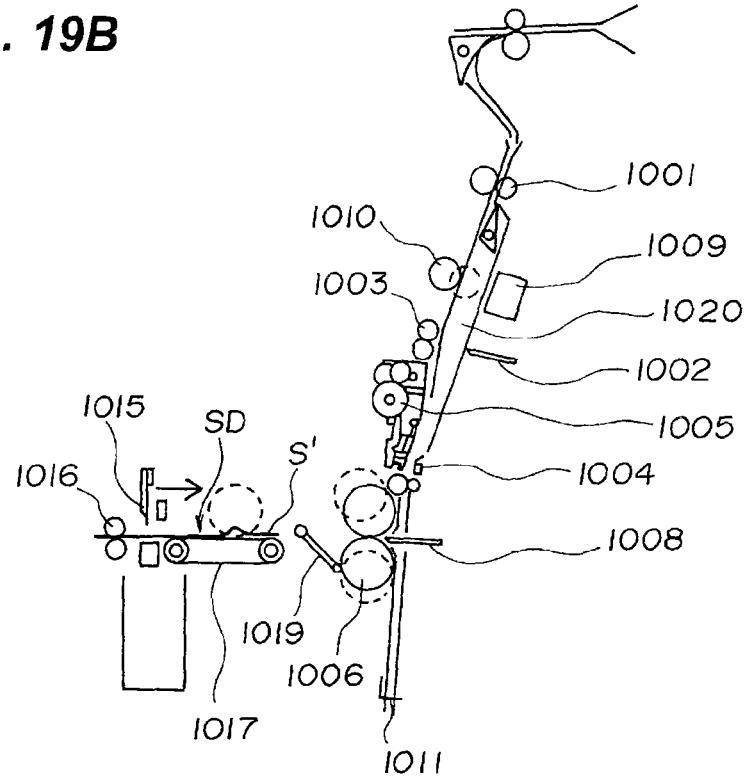

The conveying belt 1017 is reversely rotated in the position where the rear end of the cover sheet S' moves past the front end of the switching guide 1019. Here, the switching guide 1019 can be rotated in the upper and lower directions. When the rear end of the cover sheet S' moves past the front end of the switching guide 1019, as illustrated in FIG. 19B, the front end of the switching guide 1019 is moved above the conveying belt 1017.

When the conveying belt 1017 is reversely rotated, the rear end of the cover sheet S' slips under the switching guide 1019. At the same time, the pair of second folding rollers 1006 are moved in the contact direction.

Figure 20A:
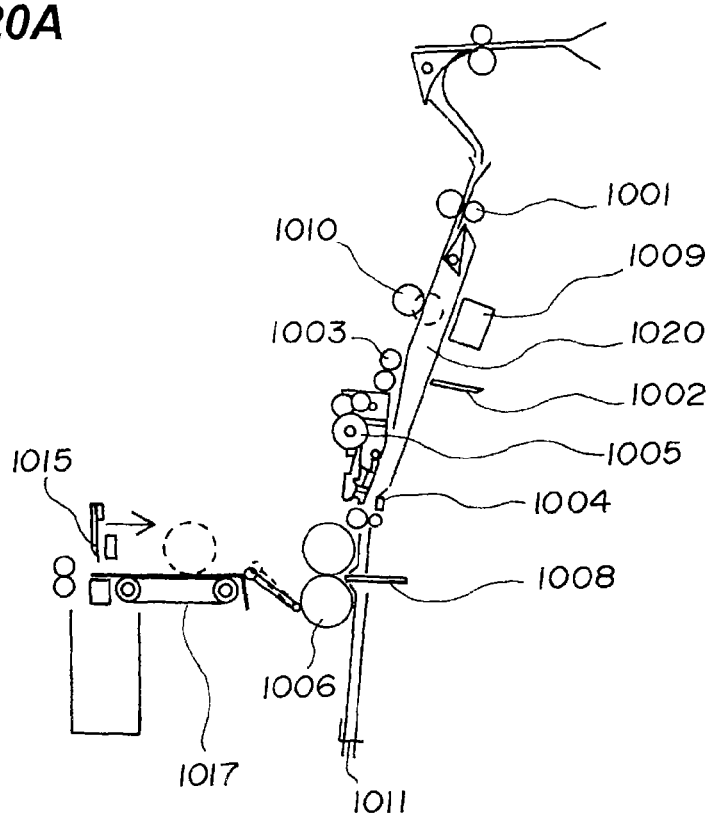
FIGS. 20A and 20B are sixth diagrams illustrating an operation of the sheet processing apparatus which creates a saddle stitched sheet bundle.

While the switching guide 1019 is operated downward, the cover sheet S' is conveyed in the direction of the pair of second folding rollers 1006 by the conveying belt 1017. As illustrated in FIG. 20A, the surface sheet S' is nipped in the position folded by the pair of first folding rollers 1003 by the pair of second folding rollers 1006. The surface sheet S' is then pressed in the gluing position for bonding.

Figure 20B:
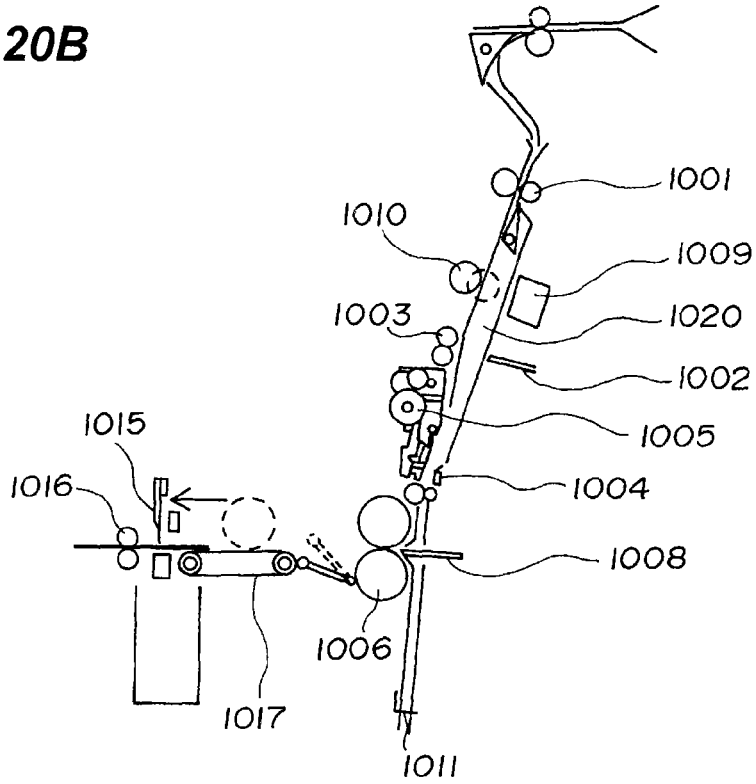

When the bonding is completed, as illustrated in FIG. 20B, the conveying belt 1017 and the pair of second folding rollers 1006 are reversely rotated again. The cover sheet S' is discharged onto the tray 1018 by the discharge roller 1016.

As illustrated in FIG. 6, the discharged product is enclosed by the cover sheet. The bookbinding product has a relatively low adhesive strength of the glue and good releasability. The bookbinding product can be repeatedly released from the bonding region. In this embodiment, the cover sheet S' is directly conveyed from the copying machine body 100 to the finisher 500. The cover sheet S' outputted from the copying machine body 100 is fed from the inserter 501, which can obtain an equivalent bookbinding product.

Figure 21:
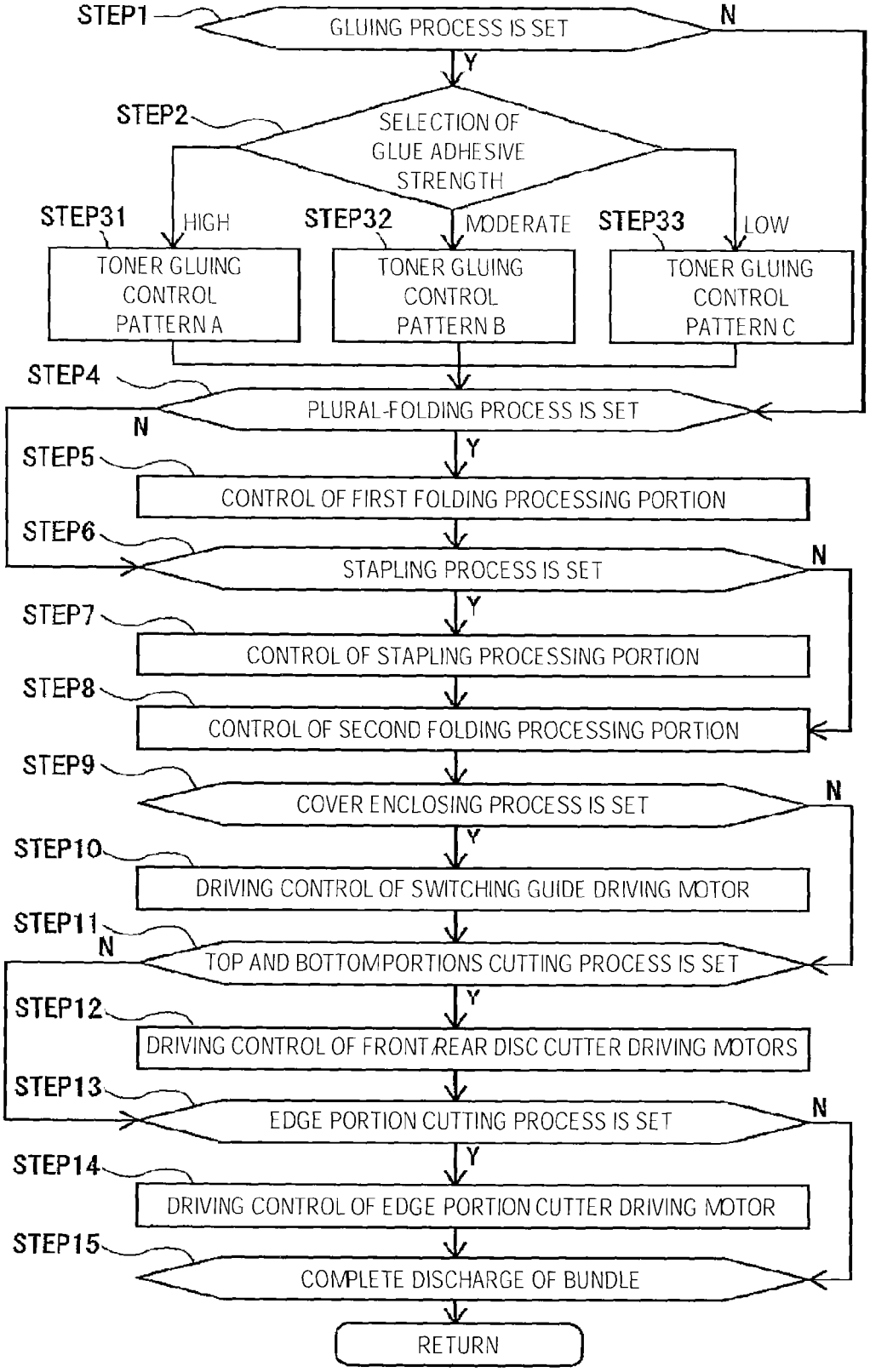
FIG. 21 is a flowchart illustrating control of a gluing process in the finisher controlling portion according to a bookbinding product to be obtained.

Control of the gluing process in the finisher controlling portion 411 according to a bookbinding product to be obtained will be described using a flowchart illustrated in FIG. 21.

Gluing information by operation of the user is set by the PC 401 or the operation portion 410 illustrated in FIG. 7 and is then transmitted to the finisher controlling portion 411 via the external I/F 402.

The finisher controlling portion 411 judges whether the gluing process is set by the operation portion 410 (STEP 1). When the gluing process is not set (N in STEP 1), the routine is advanced to STEP 4. When the gluing process is set (Y in STEP 1), the routine is moved to a glue adhesive strength selection flow of a final bookbinding product (STEP 2).

When the adhesive strength is set high, the routine is advanced to STEP 31. The amount of toner (rather small) to form the toner image 3 for adhesive strength adjustment and the gluing position are controlled by a toner gluing control pattern A set by the gluing processing portion (see FIG. 8).

When the adhesive strength is set moderately, the routine is advanced to STEP 32. The amount of toner (normal) and the gluing position are controlled by a toner gluing control pattern B. When the adhesive strength is set low, the routine is advanced to STEP 33. The amount of toner (rather large) and the gluing position are controlled by a toner gluing control pattern C.

The amount of toner forming the toner image 3 for adhesive strength adjustment is adjusted according to a bookbinding product to be obtained so as to adjust the adhesive strength of the adhesive. As described above, such adjustment of the amount of toner is performed by adjusting the forming area of the toner image or by adjusting the amount of toner per unit area of the toner image.

After the gluing process control is defined in STEPs 31 to 33, it is judged whether the plural-folding process is set (STEP 4). When the plural-folding process is not set (N in STEP 4), the routine is advanced to STEP 6. When the plural-folding process is set (Y in STEP 4), the routine is advanced to STEP 5. The first folding process is performed by control of the first folding processing portion (see FIG. 8).

It is judged whether the sheet stapling process (saddle stitching process) is set (STEP 6). When the sheet stapling process is not set (N in STEP 6), the routine is advanced to STEP 8. When the stapling process is set (Y in STEP 6), the center portion of the sheets (bundle) is subjected to the saddle stitching process by control of the stapling processing portion (see FIG. 8) (STEP 7). The folding process control of the sheets (bundle) is performed by control of the second folding processing portion (see FIG. 8) (STEP 8).

It is judged whether the cover enclosing process is set (STEP 9). When the cover enclosing process is not set (N in STEP 9), the routine is advanced to STEP 11. When the cover enclosing process is set (Y in STEP 9), the switching guide 1019 is driven by the driving control of a switching guide driving motor M1 by the folding conveying processing portion (see FIG. 8) to perform the cover enclosing process (STEP 10).

It is judged whether the top and bottom portions cutting process is set (STEP 11). When the top and bottom portions cutting process is not set (N in STEP 11), the routine is advanced to STEP 13. When the top and bottom portions cutting process is set (Y in STEP 11), the top and bottom portions of the sheets (bundle) are cut by the driving control of front/rear disc cutters (driving) motors M2 and M3 by the folding conveying processing portion (see FIG. 8) (STEP 12).

It is judged whether the edge portion cutting process is set (STEP 13). When the edge portion cutting process is not set (N in STEP 13), the routine is advanced to STEP 15. When the edge portion cutting process is set (Y in STEP 13), the edge portion of the sheets (bundle) is cut by the driving control of an edge cutter driving motor M5 by the folding conveying processing portion (see FIG. 8) (STEP 14). When such cutting of the top and bottom portions and the edge portion of the sheets (bundle) is completed, the sheets (bundle) are discharged onto the tray (STEP 15).

According to the present invention, the amount of toner of the toner image 3 for adhesive strength adjustment formed on the toner image (portion) bonded to the gluing portion N of the sheet is adjusted to adjust the adhesive strength of the adhesive.

The adhesive strength can be freely adjusted by a simple configuration without preparing an excessively large apparatus, without increasing the apparatus cost, and without increasing the production unit price of the bookbinding product. The adhesive strength setting is easy and the adhesive strength can be freely and widely adjusted. The present invention can cope with an on-demand offer type bookbinding product.

The adhesive strength of a wide variety of adhesives in the range from a liquid adhesive to a solid adhesive, such a spray adhesive, a hot melt, etc, can be adjusted without selecting the type of the adhesive. Thus, the present invention can be widely applied. The adhesive strength can be adjusted using an apparatus which has been typically widespread on the market. Thus, the present invention can be widely used.

In the above description, the finisher 500 is connected to the copying machine body 100 and processes the sheet from the copying machine body 100 online. The present invention is not limited to this. For instance, the finisher 500 can be used singly by setting the sheet having the toner image for adhesive strength adjustment to the inserter 501. In this case, the sheet bonding process is performed by control by the finisher controlling portion 411 (see FIG. 8).

The pressure roller 1010 and the gluing device 1009 configuring the adhesive applying portion and the second pushing-out member 1008 and the pair of second folding rollers 1006 configuring the sheet bonding portion may be incorporated into the copying machine body 100 for processing.

In the above description, the amount of toner of the toner image 3 for adhesive strength adjustment formed on the toner image bonded to the gluing portion N is adjusted to adjust the adhesive strength of the adhesive. The present invention is not limited to this.

The adhesive may be applied onto the normal recorded portion. In this case, the amount of the adhesive to be applied is determined based on image data from the image signal controlling portion 405 (FIG. 7). Specifically, a position and an area onto which the adhesive is applied are determined according to the amount of toner determined based on image data of the normal recorded portion image-formed by the image forming portion 120.

The toner image for adhesive strength adjustment need not be formed outside the normal recorded region. The amount of the adhesive applied is adjusted according to the amount of toner of the normal recorded portion so as to adjust the adhesive strength. When the toner image for adhesive strength adjustment is formed outside the normal recorded region, the clear (colorless) toner may be used. The colorless bonding region formed by the clear toner may be good-looking.

The image reading portion may be provided in the conveying path from the copying machine body 100 to the folding bookbinding processing portion 1000 of the finisher 500, thereby the finisher controlling portion 411 can adjust the amount of the adhesive applied according to image data read from the conveyed sheet.

When the sheet having the toner image is processed by the finisher 500 using the inserter 501, the user inputs the amount of toner absorbed (e.g., "rather small", "normal", "rather large") from the operation portion 410 to adjust the amount of the adhesive applied. Alternatively, the image reading portion may be provided in the conveying path from the inserter 501, thereby the finisher controlling portion 411 can adjust the amount of the adhesive applied according to image data read from the inserted sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-201582, filed Aug. 2, 2007, and No. 2008-189701, filed Jul. 23, 2008, which are hereby incorporated by reference herein in their entirety.

What is claimed is:

1. An image forming apparatus, comprising:

an image forming portion which forms a toner image on a sheet;

a fixing device which fixes the toner image on the sheet;

a sheet processing apparatus having an adhesive applying portion which applies an adhesive onto the same sheet on which the toner image is fixed or onto a different sheet, the sheet processing apparatus performing a process of bonding sheets so that the fixed toner image on the sheet and a bonding region of the sheet onto which the adhesive is applied by the adhesive applying portion are bonded together without heating; and a controller which controls the image forming portion, wherein the controller adjusts the amount of toner of the toner image formed by the image forming portion in order to adjust adhesive strength of the adhesive.

2. The image forming apparatus according to claim 1, the sheet processing apparatus comprising a folding unit which folds the sheet, wherein the toner image and the bonding region are formed on a single sheet, and wherein when the sheet is folded by the folding unit, the toner image and the bonding region are bonded together.

3. The image forming apparatus according to claim 1, wherein the toner image is formed on one of two sheets, and the bonding region is formed on the other sheet, the two sheets are sealed by bonding the toner image and the bonding region together.

4. An image forming apparatus, comprising:

an image forming portion which forms a toner image on a sheet;

a fixing device which fixes the toner image on the sheet;

a sheet processing apparatus having an adhesive applying portion which applies an adhesive onto the same sheet on which the toner image is fixed or onto a different sheet, the sheet processing apparatus performing a process of bonding sheets so that the fixed toner image on the sheet and a bonding region of the sheet onto which the adhesive is applied by the adhesive applying portion are bonded together without heating; and a controller which controls the image forming portion, wherein the controller adjusts the forming area of the toner image in order to adjust the adhesive strength of the adhesive.

5. The image forming apparatus according to claim 4, the sheet processing apparatus comprising a folding unit which folds the sheet, wherein the toner image and the bonding region are formed on a single sheet, and wherein when the sheet is folded by the folding unit, the toner image and the bonding region are bonded together.

6. The image forming apparatus according to claim 4, wherein the toner image is formed on one of two sheets, and the bonding region is formed on the other sheet, the two sheets are sealed by bonding the toner image and the bonding region together.

7. An image forming apparatus, comprising:

an image forming portion which forms a toner image on a sheet;

a fixing device which fixes the toner image on the sheet;

a sheet processing apparatus having an adhesive applying portion which applies an adhesive onto the same sheet on which the toner image is fixed or onto a different sheet, the sheet processing apparatus performing a process of bonding sheets so that the fixed toner image on the sheet and a bonding region of the sheet onto which the adhesive is applied by the adhesive applying portion are bonded together without heating; and a controller which controls the image forming portion, wherein the controller adjusts the amount of toner per unit area of the toner image in order to adjust the adhesive strength of the adhesive.

8. The image forming apparatus according to claim 7, the sheet processing apparatus comprising a folding unit which folds the sheet, wherein the toner image and the bonding region are formed on a single sheet, and wherein when the sheet is folded by the folding unit, the toner image and the bonding region are bonded together.

9. The image forming apparatus according to claim 7, wherein the toner image is formed on one of two sheets, and the bonding region is formed on the other sheet, the two sheets are sealed by bonding the toner image and the bonding region together.

10. An image forming apparatus, comprising:

an image forming portion which forms a toner image on a sheet;

a fixing device which fixes the toner image on the sheet;

a sheet processing apparatus having an adhesive applying portion which applies an adhesive onto the same sheet on which the toner image is fixed or onto a different sheet, the sheet processing apparatus performing a process of bonding sheets so that the fixed toner image on the sheet and a bonding region of the sheet onto which the adhesive is applied by the adhesive applying portion are bonded together without heating;

a controller which controls the image forming portion; and an inputting portion which specifies the magnitude of the adhesive strength of the adhesive, wherein the controller adjusts the amount of toner according to the magnitude of the adhesive strength specified by the inputting portion.

11. The image forming apparatus according to claim 10, the sheet processing apparatus comprising a folding unit which folds the sheet, wherein the toner image and the bonding region are formed on a single sheet, and wherein when the sheet is folded by the folding unit, the toner image and the bonding region are bonded together.

12. The image forming apparatus according to claim 10, wherein the toner image is formed on one of two sheets, and the bonding region is formed on the other sheet, the two sheets are sealed by bonding the toner image and the bonding region together.

13. An sheet processing apparatus which performs a process of bonding sheets, at least one of the sheets having a toner image which is fixed by a fixing device, comprising:

an adhesive applying portion which applies an adhesive onto the same sheet on which the toner image is fixed or onto different sheet;

a sheet processing portion which performs the process of bonding sheets, the sheet processing portion performing the process of bonding sheets so that the fixed toner image on the sheet and a bonding region of the sheet onto which the adhesive is applied by the adhesive applying portion on the sheet are bonded together without heating; and a controlling portion which controls the adhesive applying portion, wherein the controlling portion adjusts the amount of the adhesive applied by the adhesive applying portion according to the amount of toner of the toner image in order to adjust adhesive strength of the adhesive.

14. The sheet processing apparatus according to claim 13, wherein the bonding region is formed on the sheet which the toner image is formed, wherein the sheet processing portion has a folding unit which folds the sheet, and wherein when the sheet is folded by the folding unit, the toner image and the bonding region are bonded together.

15. The sheet processing apparatus according to claim 13, wherein the toner image is formed on one of two sheets, and the bonding region is formed on the other sheet, and the two sheets are sealed by bonding the fixed toner image and the bonding region together.

* * * * *